US012285125B1

(12) United States Patent
Tanaka et al.

(10) Patent No.: US 12,285,125 B1
(45) Date of Patent: Apr. 29, 2025

(54) CONNECTOR

(71) Applicant: Kura Sushi, Inc., Sakai (JP)

(72) Inventors: Kunihiko Tanaka, Osaka (JP); Tadanori Sugimoto, Sakai (JP); Hidetoshi Nakamura, Sakai (JP)

(73) Assignee: Kura Sushi, Inc.

( * ) Notice: Subject to any disclaimer, the term of this patent is extended or adjusted under 35 U.S.C. 154(b) by 0 days.

(21) Appl. No.: 18/886,756

(22) Filed: Sep. 16, 2024

(30) Foreign Application Priority Data

Feb. 9, 2024 (JP) ..... 2024-018851
Jun. 28, 2024 (JP) ..... 2024-105585

(51) Int. Cl.
*A47G 23/06* (2006.01)
*A47F 10/06* (2006.01)

(52) U.S. Cl.
CPC ..... *A47G 23/0633* (2013.01); *A47F 10/06* (2013.01)

(58) Field of Classification Search
CPC .. B65D 1/34; B65D 21/0204; B65D 81/3288; B65D 41/3442; B65D 2251/02; B65D 2401/20; B65D 41/325; B65D 41/3447; B65D 55/16; B65D 2575/583; B65D 2575/586; B65D 75/5883; A47G 23/0633; A47F 10/06
See application file for complete search history.

(56) References Cited

U.S. PATENT DOCUMENTS

2005/0178762 A1* 8/2005 Klosterman ..... A47F 3/007 219/679
2012/0031741 A1* 2/2012 Ishino ..... A47F 10/06 198/793
2014/0102998 A1* 4/2014 Waksul ..... A47F 7/0064 211/41.2
2015/0101225 A1 4/2015 Jones
2020/0039689 A1* 2/2020 Leinbach ..... B65D 43/02
2023/0218098 A1* 7/2023 Tanaka ..... A47G 23/08 220/574
2024/0115064 A1* 4/2024 Lucas ..... B65D 21/0204

FOREIGN PATENT DOCUMENTS

JP H06-56480 U 8/1994
JP 2001-299553 A 10/2001
JP 2007-313135 A 9/2012

* cited by examiner

*Primary Examiner* — Shawn M Braden
(74) *Attorney, Agent, or Firm* — Best Mode IP Law, PLLC; Yusuke Hirai

(57) ABSTRACT

A connector connects two containers to each other, each of the two containers being configured to house a plate on which a food or a drink is placed and being conveyed on a conveying path. The connector includes: a pair of attachment portions each of which is attached to a respective one of the two containers; and a connecting portion that is configured to connect the attachment portions to each other. The connecting portion has a length so that a display member that presents a display visible to a customer is attached to the connecting portion.

13 Claims, 31 Drawing Sheets

CONNECTOR

CROSS REFERENCE TO RELATED APPLICATION

This application is based on and claims the benefit of priority from Japanese Patent Application No. 2024-18851 filed on Feb. 9, 2024 and Japanese Patent Application No. 2024-105585 filed on Jun. 28, 2024. The entire disclosure of the above applications is incorporated herein by reference.

TECHNICAL FIELD

The present disclosure relates to a connector for connecting a pair of containers each of which houses a container on which a food or a drink is placed and is conveyed along a conveying path.

BACKGROUND

Restaurants commonly known as conveyor belt sushi restaurants are equipped with food/drink conveying devices having conveying paths that moves in a circular motion along customer seats. In such restaurants, a staff places a food or a drink such as sushi on a container, such as a plate, and then moves the plate with the food or drink onto a conveying path to sequential convey the plate to customers' seats. Customers take, from the conveying path, plates carrying foods or drinks such as sushi that are delivered in sequence to eat the food or drink the drink.

However, since the sushi is conveyed on the conveying path with the plate being open, the sushi easily dries out. There is also a risk that the sushi on the plate may be accidentally touched by customers. Therefore, there has been a demand for preventing sushi from drying out and serving sushi hygienically. Therefore, one solution has been proposed by using a cover member to cover the plate with sushi. After the plate is covered by the cover member, the plate is conveyed on the conveying path of a conveying device.

SUMMARY

In some restraints, so-called POP advertisements for informing customers of foods and drinks are placed on plates that are conveyed along the conveying path. However, since the POP advertisements are placed on the plates, foods and drinks need to be placed on different plates. This makes it difficult for customers to understand the relationship the POP advertisements with advertised foods and drinks.

One objective of the present disclosure is to provide a connector that is conveyed together with plates with a food or a drink and that is configured to inform customers of the food or drink on the plates or provide a notification that indicates an advertisement.

A first aspect of the present disclosure is a connector that connects two containers to each other, each of the two containers being configured to house a plate on which a food or a drink is placed and being conveyed on a conveying path. The connector includes: a pair of attachment portions each of which is attached to a respective one of the two containers; and a connecting portion that is configured to connect the attachment portions to each other. The connecting portion has a length so that a display member that presents a display visible to a customer is attached to the connecting portion.

A second aspect of the present disclosure is the connector according to the first aspect. The display member has a lower end linearly extending, and the connecting portion has the length so that the lower end of the display member is placed on the connecting portion.

A third aspect of the present disclosure is the connector according to the first aspect. The connecting portion has a rigidity to keep a constant distance between the two containers.

A fourth aspect of the present disclosure is the connector according to the first aspect. Each of the two containers has a base that is placed on the conveying path, and each of the attachment portions includes a support portion that is configured to support the base.

A fifth aspect of the present disclosure is the connector according to the fourth aspect. The support portion includes an anti-rotation portion that is configured to restrict the support portion from rotating relative to the base.

A sixth aspect of the present disclosure is the connector according to the first aspect. Each of the container has a cylindrical base that is placed on the conveying path, and each of the attachment portions is formed in an annular shape to be attached to an outer circumferential surface of the base.

A seventh aspect of the present disclosure is the connector according to the first aspect. The connecting portion is fixed to the two containers at a constant angle relative to each of the two containers.

An eighth aspect of the present disclosure is the connector according to the first aspect. The connecting portion is detachably fixed to the attachment portions.

A ninth aspect of the present disclosure is the connector according to the first aspect. The connecting portion includes a display member attachment portion to which the display member is attached.

A tenth aspect of the present disclosure is a connector that connects two containers to each other, each of the two containers being configured to house a plate on which a food or a drink is placed and being conveyed on a conveying path. The connector includes: a pair of attachment portions each of which is attached to a respective one of the two containers; and a connecting portion that is configured to connect the attachment portions to each other. The connecting portion is configured to provide a notification that is visible to a customer.

An eleventh aspect of the present disclosure is the connector according to the first aspect. The connecting portion is configured to be separable into two parts.

A twelfth aspect of the present disclosure is the connector according to the eleventh aspect. Each of the two parts is formed in a shape of a hand, and the connecting portion has a shape of a handshake when the two parts are connected to each other.

The connector according to the present disclosure is capable of informing customers of information on a food or a drink on the plate or providing a notification to present advertisement to customers while being conveyed together with plates.

DETAILED DESCRIPTION OF EMBODIMENTS

A. First Embodiment

<1. Overview of a Food/Drink Supply System>

Figure 1:
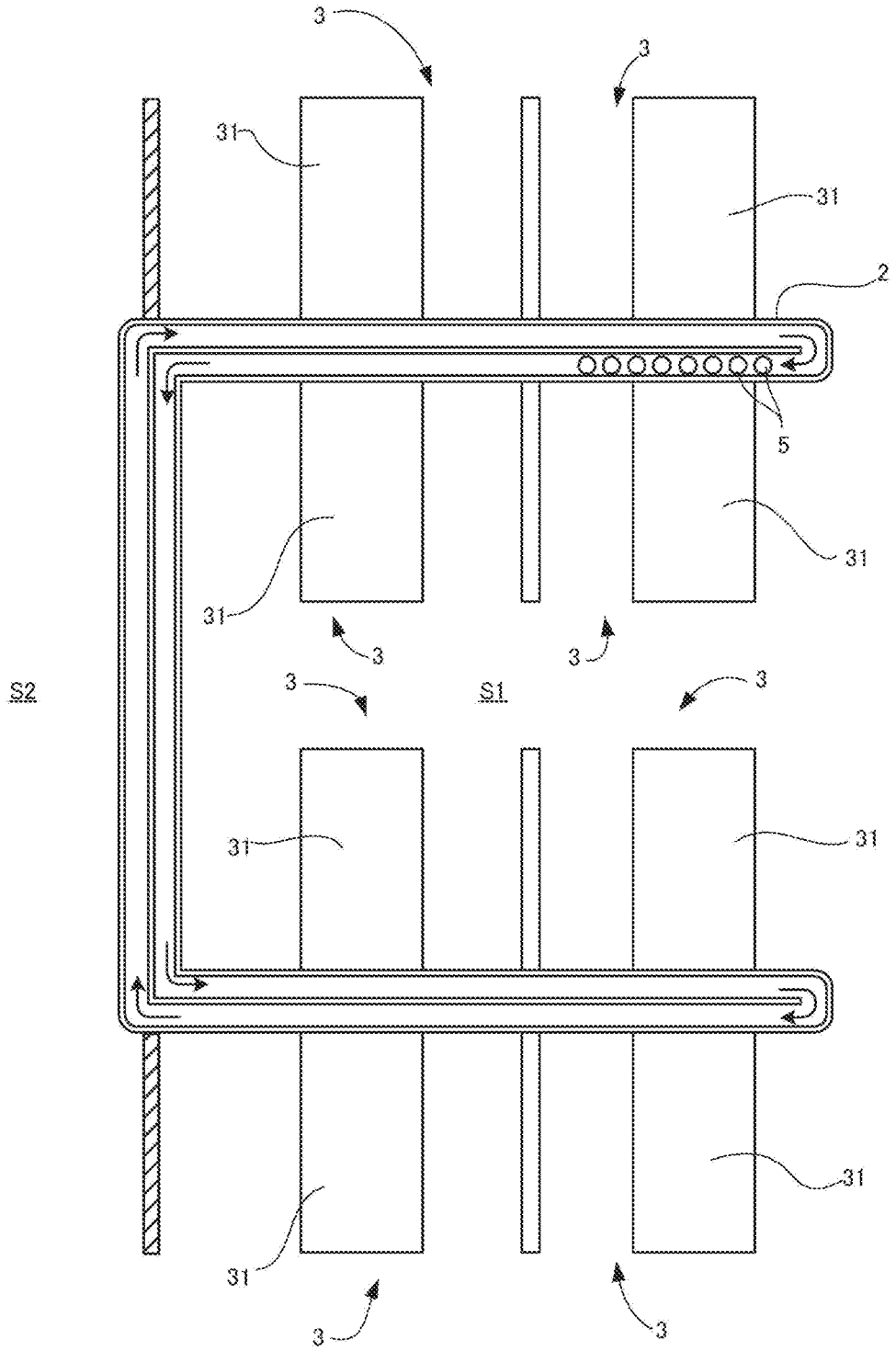
FIG. 1 is a plan view of a food/drink supply system according to one embodiment of the present disclosure.

Hereinafter, a first embodiment of a food/drink supply system for conveying a container according to the present disclosure will be described with reference to drawings. FIG. 1 is a plan view of the food/drink supply system, FIG. 2 is a cross-sectional view of a conveying path, and FIG. 3 is a front view of the conveying path.

Figure 2:
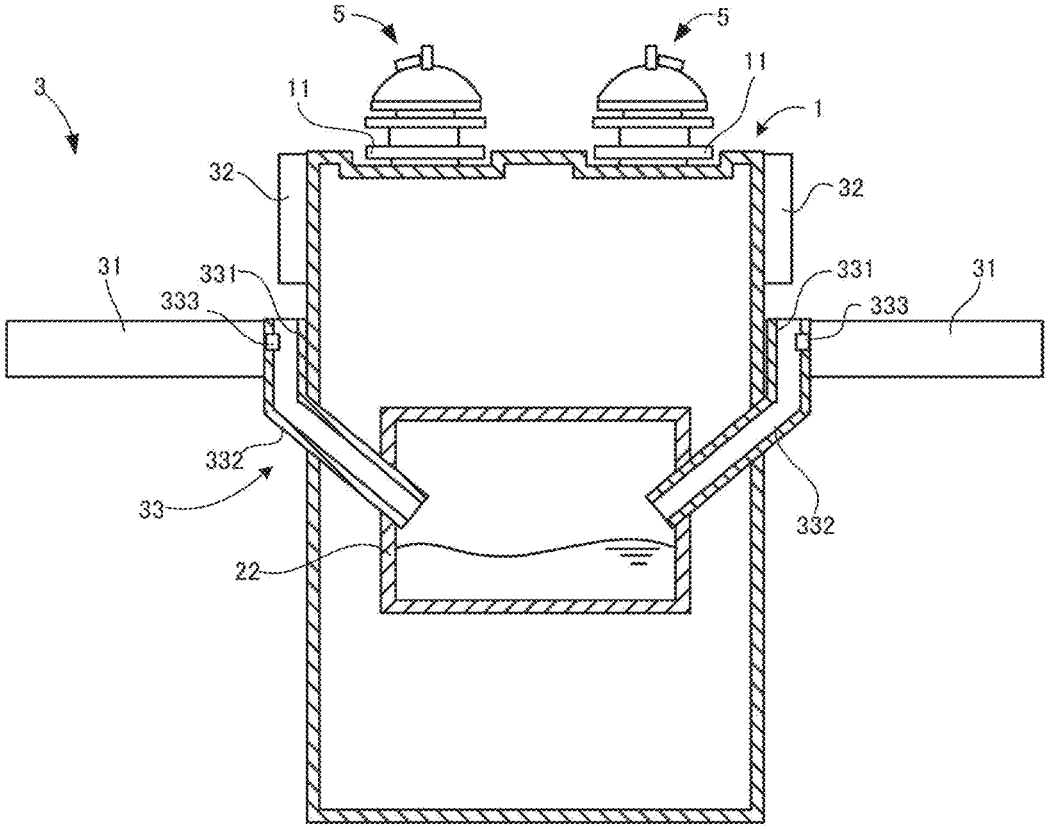
FIG. 2 is a cross-sectional view of a conveying path.
Figure 3:
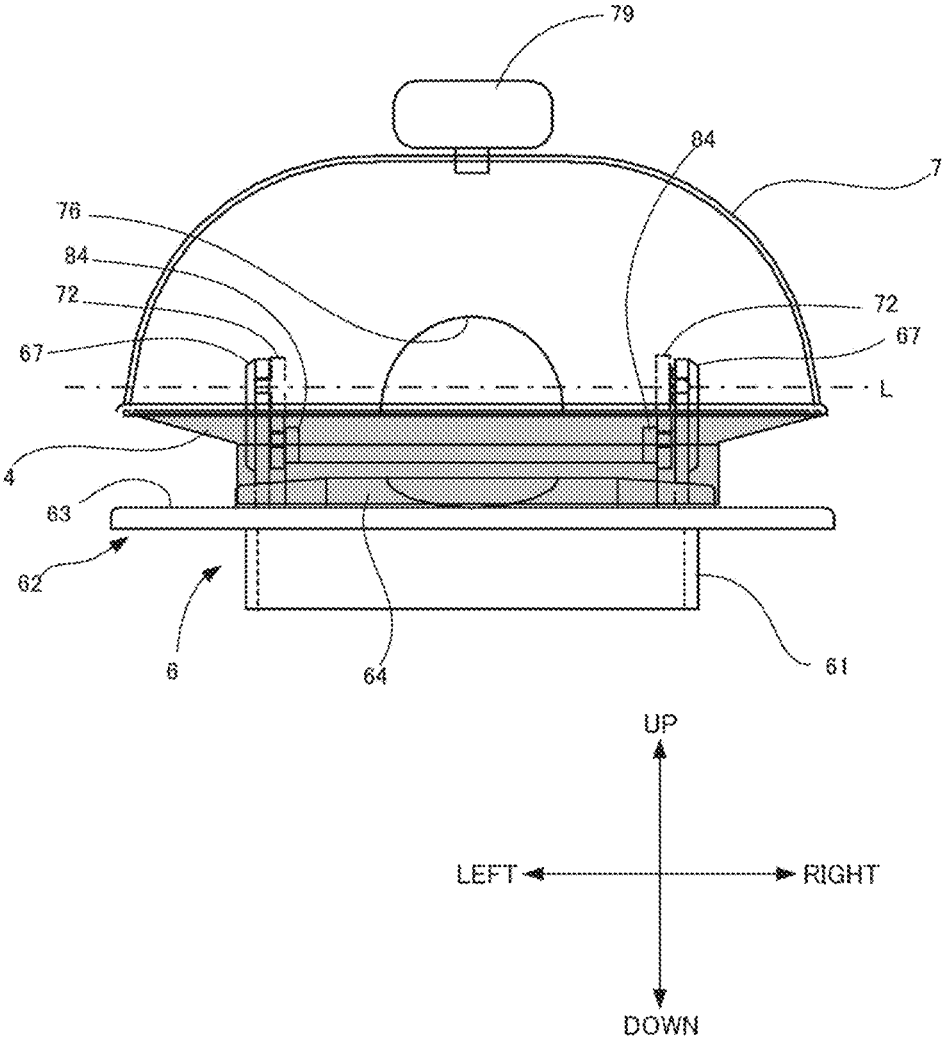
FIG. 3 is a front view of a container in a closed state.

As shown in FIGS. 1 and 2, the food/drink supply system of this embodiment is, as an example, installed in a sushi restaurant, and has the conveying path 1 for conveying containers 5 housing foods or drinks between a customer space S1 and a kitchen space S2. The customer space S1 is provided with a plurality of dining booths 3 separated by partitions, and the dining booths 3 are arranged along the conveying path 1. Each booth 3 is provided with a rectangular table 31, one side of which extends to the conveying path 1.

The container 5 conveyed by the conveying path 1 houses a plate 4 on which a food or drink (sushi, soup, sweets, drinks, etc.) is placed, and customers at each dining booth 3 take out the plate 4 from the container 5 on the conveying path 1 and eat or drink at the table 31.

As shown in FIG. 2, a touch panel display 32 through which orders are placed, payments are made, and the like, and a plate collecting device 33 that is configured to collect plates 4 are disposed for the table 31 of each customer booth 3. Food and drink ordered through the touch panel display 32 are conveyed by a second conveying path 2 from the kitchen space S2 to the table 31 where the order was placed. Information regarding the ordered food and drink is stored as order information in a processing device (not shown). Next, each device will be described in detail.

<2. Conveying Path>

As shown in FIG. 2, the conveying path 1 has two lanes on which flat chain conveyors 11 are arranged, and each of the flat chain conveyors 11 is circulated between the customer space S1 and the kitchen space S2 by a motor (not shown). The above-mentioned containers 5 are arranged at predetermined intervals on the flat chain conveyors 11 and move along the conveying path 1.

<3. Plate Collecting Device>

Next, the plate collecting device 33 will be described. As shown in FIG. 2, the plate collecting device 33 is equipped with a guide path 332 that opens at the table 31 and has an insertion port 331 through which the plate 4 is inserted, and a sensor 333 that is provided inside the guide path 332 and detects a plate 4 that has passed through. The guide path 332 extends obliquely downward from the table 31 and is connected to a plate collecting water path 22 provided inside the conveying path 1. The plate collecting water path 22 extends to the kitchen space S2 and is connected to a storage tank (not shown) provided in the kitchen space S2. Water flows through the plate collecting water path 22 toward the storage tank, and when a plate 4 is dropped into the plate collecting water path 22 via the guide path 332, the plate 4 is carried by the water to the storage tank. The plate 4 is then collected in the storage tank, washed, and reused.

When the plates 4 passing through the guide path 332 are detected by the sensor 333, the type of each plate 4 and the number of the plates 4 are transmitted to the processing device and stored as collection information. This collection information is used at the time of payment, and when a payment button (not shown) on the touch panel display 32 is touched, the price along with the number and type of consumed plates are displayed on the touch panel display based on the collection information and the above-mentioned order information. If the customer agrees, a message prompting the customer to pay the fee at a POS register is displayed on the touch panel display 32. Alternatively, a billing process may be performed by calling a staff who will count the number of consumed plates.

<4. Container>

Figure 4:
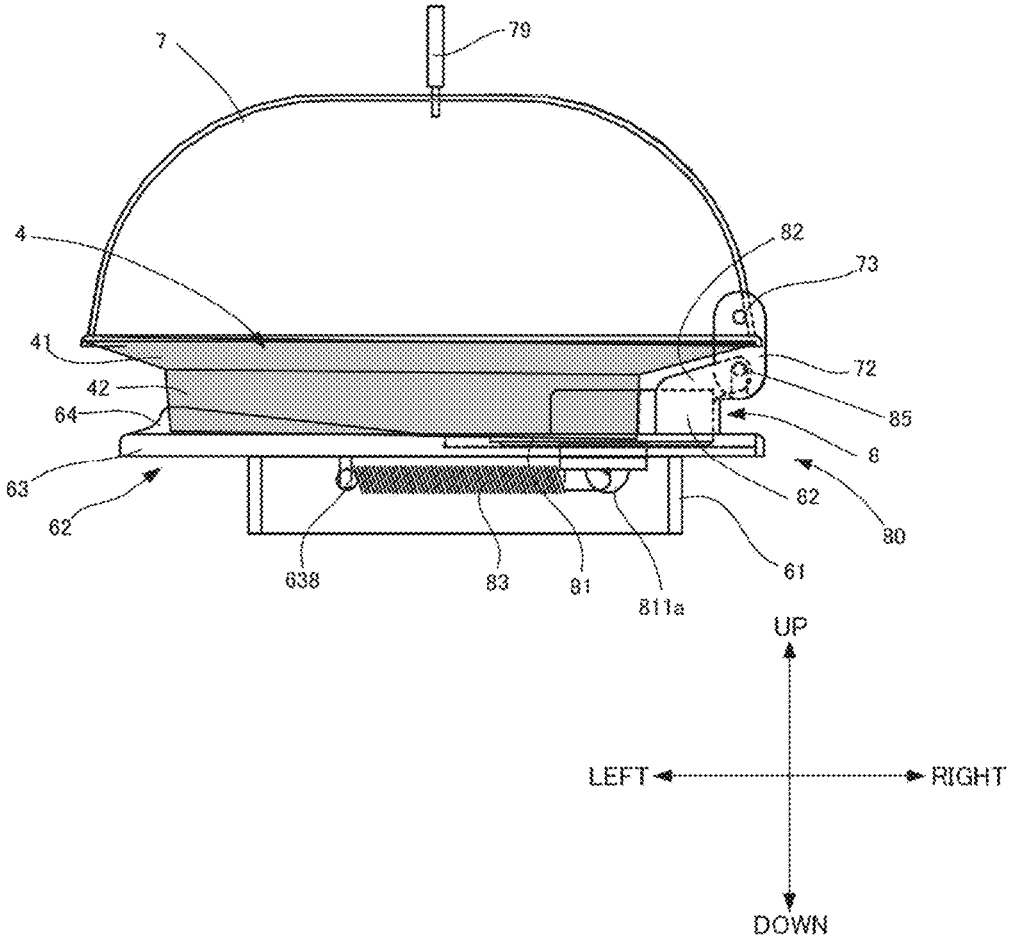
FIG. 4 is a side view of FIG. 3.
Figure 5:
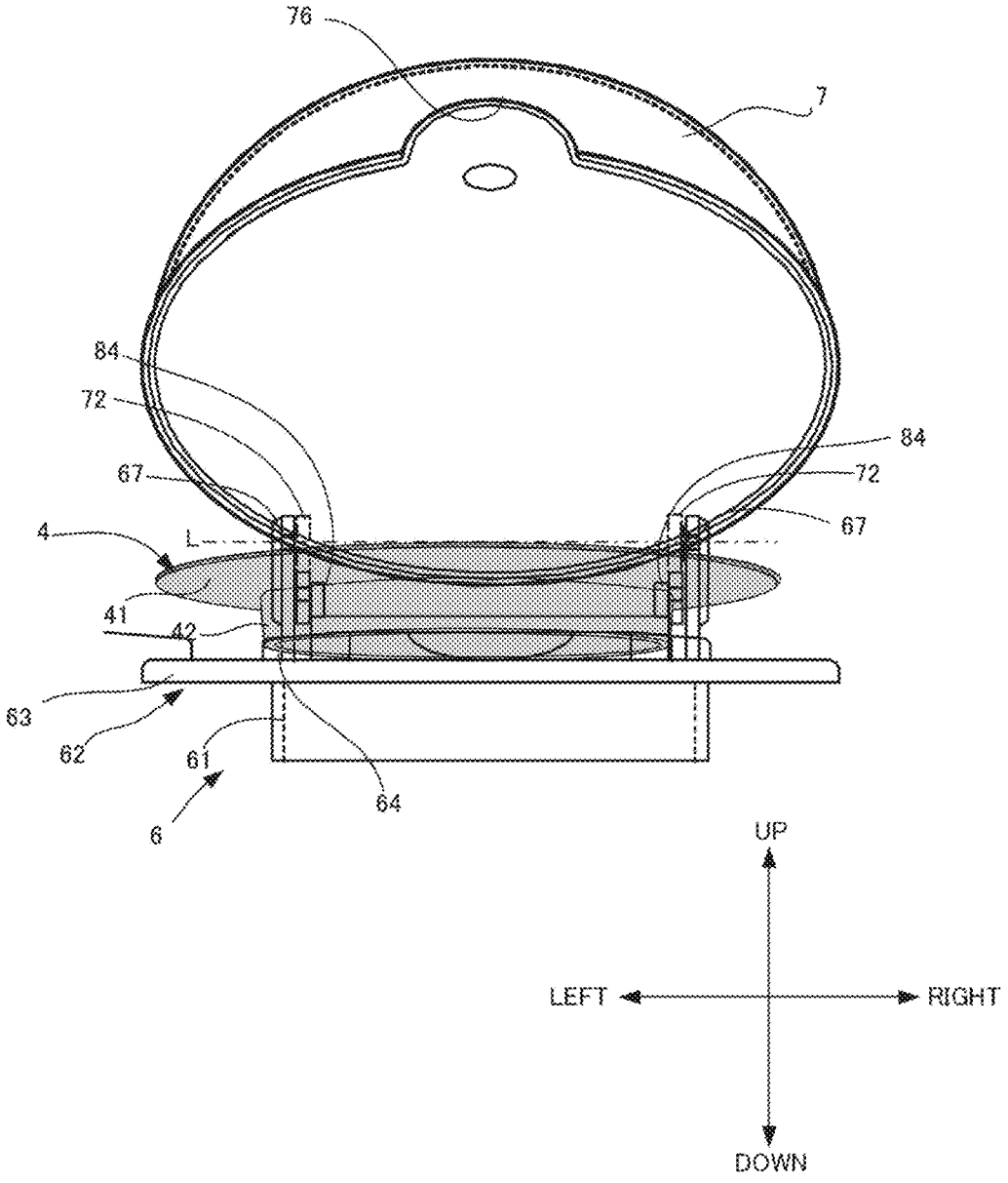
FIG. 5 is a front view of the container in an open state.
Figure 6:
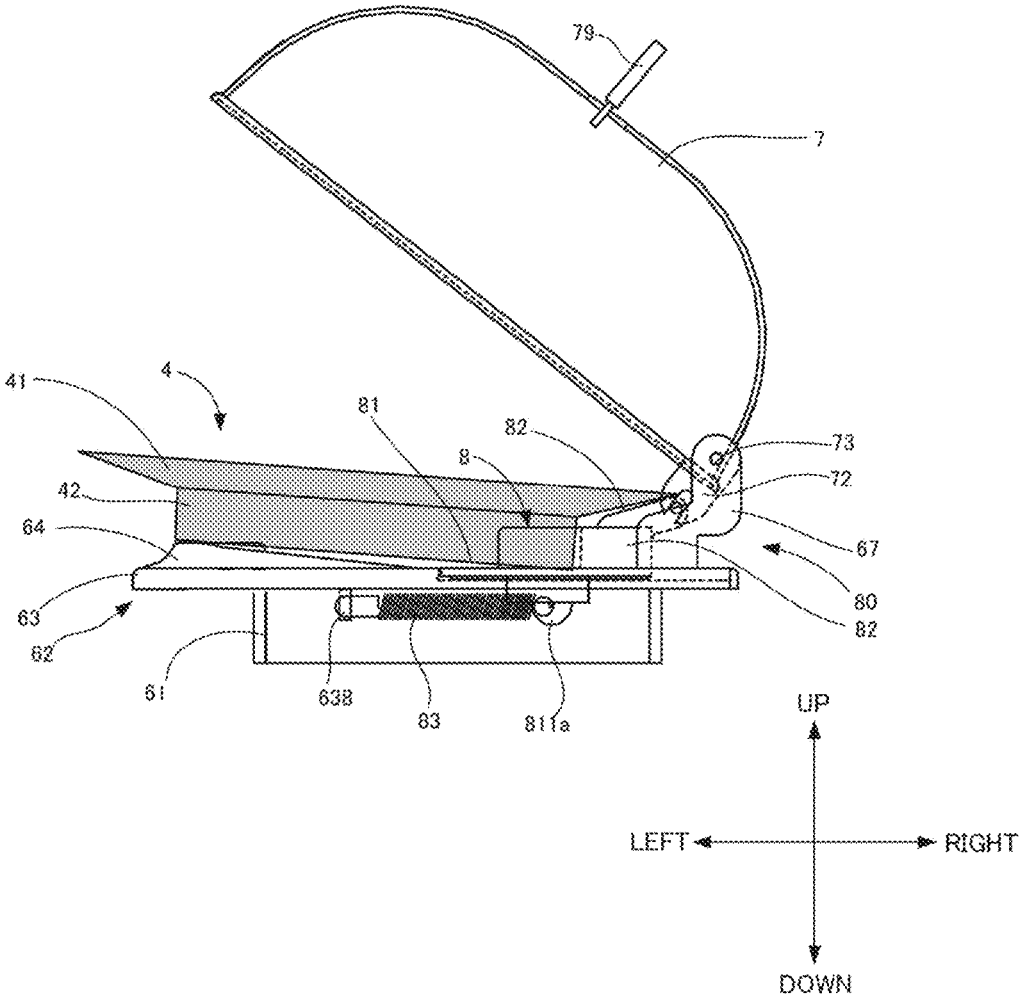
FIG. 6 is a side view of FIG. 5.

Next, the container 5 will be described with reference to FIGS. 3-16. FIG. 3 is a front view of the container in a closed state, FIG. 4 is a side view of FIG. 3, FIG. 5 is a front view of the container in an open state, and FIG. 6 is a side view of FIG. 5. For explanation purposes, the plate 4 is shown as colored and semi-transparent in FIGS. 3-6. First, the plate 4 housed in the container 5 will be described. For example, as shown in FIG. 3, the plate 4 includes a plate body 41 having a circular shape in plan view, and a cylindrical base 42 which protrudes downward from a lower surface of the plate body 41. The plate body 41 and the cylindrical base 42 are integrally formed. Food or drink (not shown) such as sushi is placed on the plate body 41.

Next, the container 5 will be described. As shown in FIGS. 3 to 6, the container 5 includes a mounting base 6 having a mounting position at which a plate 4 is placed, a lid body 7 to cover an upper surface of the mounting base 6, and an open/close mechanism 80 to close the lid body 7 when the plate 4 is placed at the mounting position and to open the lid body 7 when the plate 4 is removed from the mounting position. Each component of the container will be described in detail below. For convenience of explanation, the following description will be given based on the directions shown in FIGS. 3 to 6, but the present invention is not limited to these directions.

<4-1. Mounting Base>

Figure 7:
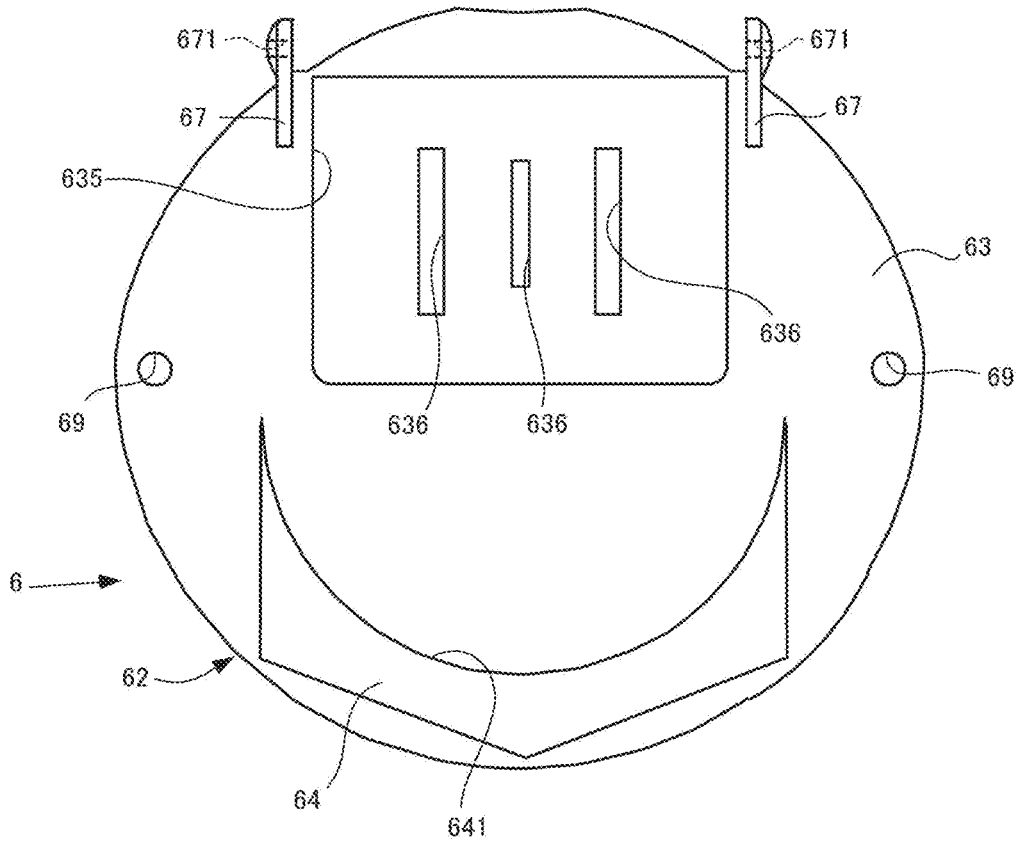
FIG. 7 is a plan view of a mounting base.
Figure 8:
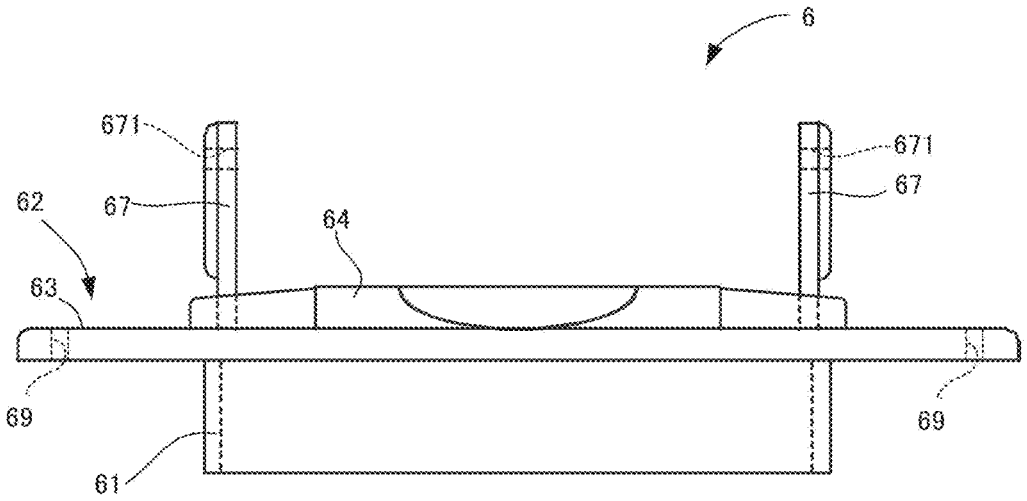
FIG. 8 is a front view of FIG. 7.
Figure 9:
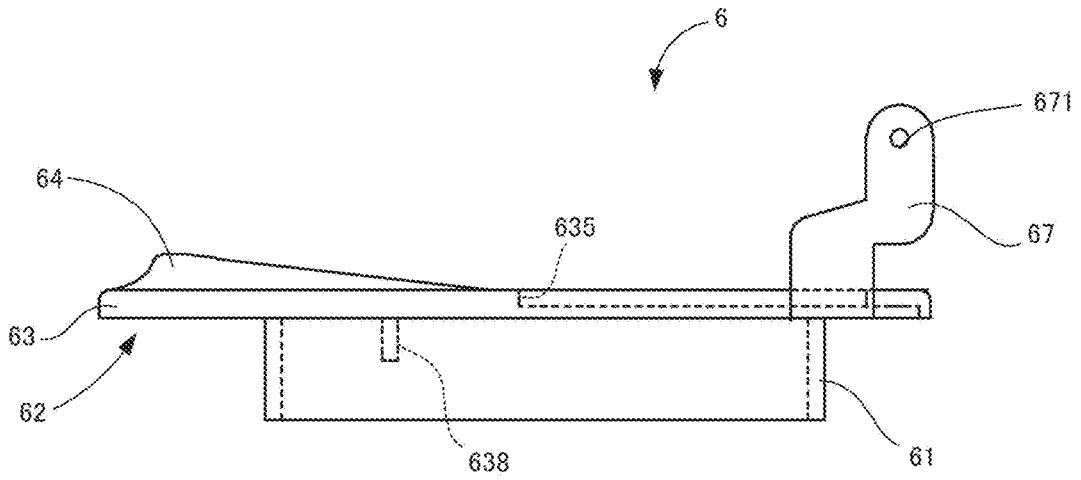
FIG. 9 is a side view of FIG. 7.

FIG. 7 is a plan view of the mounting base and an operating member, FIG. 8 is a front view of FIG. 7, and FIG. 9 is a side view of FIG. 7. As shown in FIGS. 7 and 8, the mounting base 6 includes a cylindrical base 61 and a mounting portion 62 provided at the upper end of the base 61, which are integrally formed. The plate 4 is placed on the upper surface of the mounting portion 62, and the plate 4 is held at the mounting position, which will be described below. The mounting portion 62 includes a mounting plate 63 having a circular shape in plan view, a stopper 64 disposed at a front end of the upper surface of the mounting plate 63, and a pair of support pieces 67 which are arranged at a rear end of the mounting plate 63 to rotatably support the lid body 7.

The stopper 64 protrudes from the mounting plate 63 and extends along a front edge of the mounting plate 63. An arc-shaped inner surface 642 is formed at the rear edge of the stopper 64, and an outer surface of the base 42 of the plate 4 comes into contact with the inner surface 642. Circular through holes 69 are formed near outer edges of both sides of the mounting plate 63.

Further, a recess 635 having a rectangular shape in plan view is formed on the upper surface of the mounting plate 63 at a position backward of the center in a front-rear direction, and an operating element 8 (described later) is disposed in the recess 635. In addition, a plurality of elongated through holes 636 extending in the front-to-rear direction are formed in a bottom surface of the recess 635, and as described below, protrusions 811 of the operating element 8 are inserted into the through holes 636. As described below, the base 42 of the plate 4 is clamped between a second inner surface 642 of the stopper 64 and the operating element 8, thereby holding the plate 4 on the mounting base 6. The position at which the plate 4 is held when clamped is referred to as the mounting position. FIGS. 3 and 4 show the plate 4 at the mounting position.

As shown in FIGS. 8 and 9, the pair of support pieces 67 described above are attached to the mounting plate 63 to sandwich the recess 635 therebetween, and extend upward from the mounting plate 63. A through hole 671 is formed at the upper end of each support piece 67, and the protrusion 73 of the lid body 7 is rotatably inserted into the through holes 671 so that the lid body 7 is cable of being opened and closed. That is, the support pieces 67 serves as a hinge for opening and closing the lid body 7 relative to the mounting portion 62.

<4-2. Lid>

Figure 10:
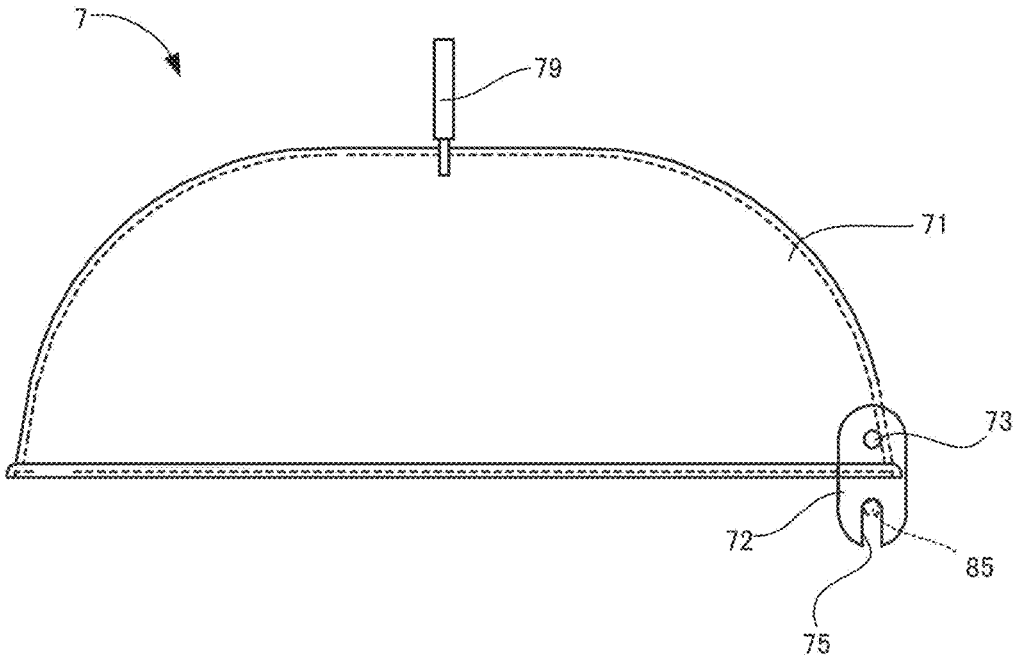
FIG. 10 is a side view of a lid body.

FIG. 10 is a side view of the lid. As shown in FIG. 10, the lid body 7 includes a dome-shaped main body 71 and a pair of left and right arm pieces 72 extending downward from a rear end of the main body 71, which are integrally formed. The main body 71 and the arm pieces 72 are made of a transparent synthetic resin material, so that the inside can be seen from an outside. The above-mentioned protrusion 73 is formed near an upper end of each arm piece 72, and each protrusion 73 is rotatably fitted into the through hole 671 of the support piece 67 of the mounting portion 62. Each protrusion 73 protrudes in the left-right direction, which allows the lid 7 to rotate about a pivot axis L (see FIG. 4, etc.) that passes through both the protrusions 73 and extends in the left-right direction, thereby making it possible to open and close the lid 7 relative to the mounting plate 63.

Further, at the lower end of each arm piece 72, an elongated notch 75 extending upward is formed. A connecting shaft 85 of the operating element 8 (described later) is inserted into the notches 75.

The outer diameter of the lid body 7 is approximately the same as the outer diameter of the mounting plate 63, and as shown in FIG. 3, when the lid body 7 is in the closed state, the lower edge of the lid body 7 is positioned above a circumferential edge of the mounting plate 63 with a space. The plate 4 is housed in this space. Furthermore, as shown in FIG. 3, an arc-shaped cutout 76 is formed in the lower edge of the front portion of the lid 7, and the plate 4 housed therein can be grasped through the cutout 76. A through hole 77 is formed at the top of the lid body 7, and a display tag 79 indicative of the type of housed food or drink is attached into the through hole 77. The display tag 79 can display the type of sushi, such as tuna, sea bream, etc.

<4-3. Open/Close Mechanism>

Next, the open/close mechanism will be described. As shown in FIGS. 4 and 6, the open/close mechanism 80 includes the operating element 8 disposed on the mounting plate 63, and a coil spring (biasing means) 83 for biasing the operating element 8 forward.

Figure 11A:
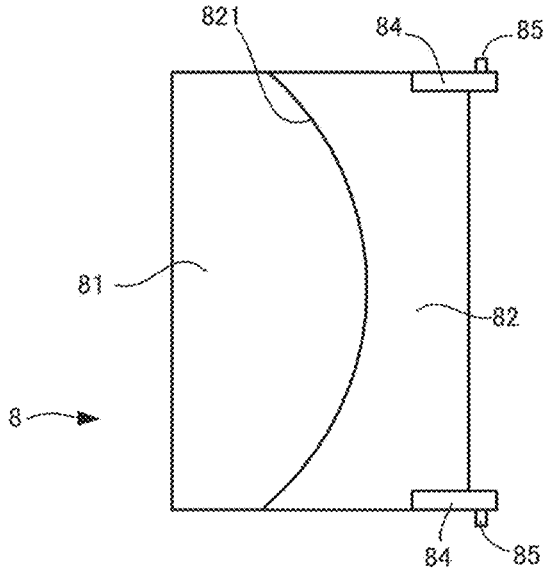
FIG. 11A is a plan view.
Figure 11B:
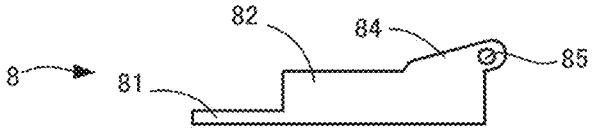
FIG. 11B is a side view.
Figure 11C:
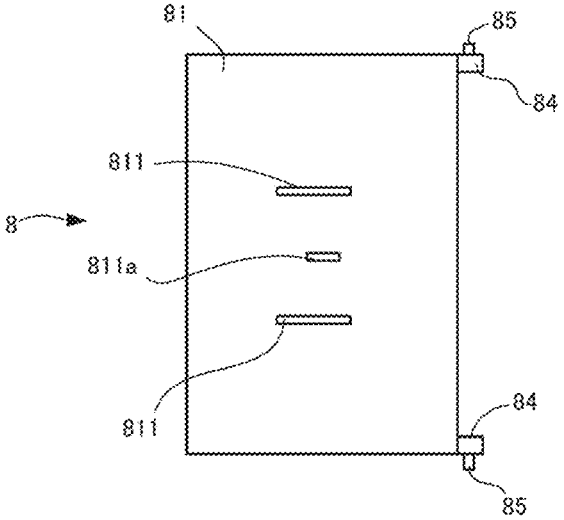
FIG. 11C is a bottom view of an operating element.

First, the operating element 8 will be described. FIG. 11A is a plan view, FIG. 11B is a side view, and FIG. 11C is a bottom view of the operating element. As shown in FIG. 11A-11C, the operating element 8 is disposed in the recess 635 of the above-mentioned mounting plate 63 and includes a plate-shaped main body portion 81 which slides in the front-to-rear direction within the recess 635, and a support portion 82 which protrudes upward from the rear end of the main body portion 81. The support portion 82 is formed in a rectangular shape in plan view. The support portion 82 has an inner surface 821 at the front of the support portion 82.

The inner surface 821 is concave in an arc shape toward the rear, and the inner surface 821 is in contact with the outer surface of the base 42 of the plate 4. That is, the base 42 of the plate 4 is interposed between the inner surface 821 of the operating element 8 and the second inner surface 642 of the stopper 64.

Figure 13:
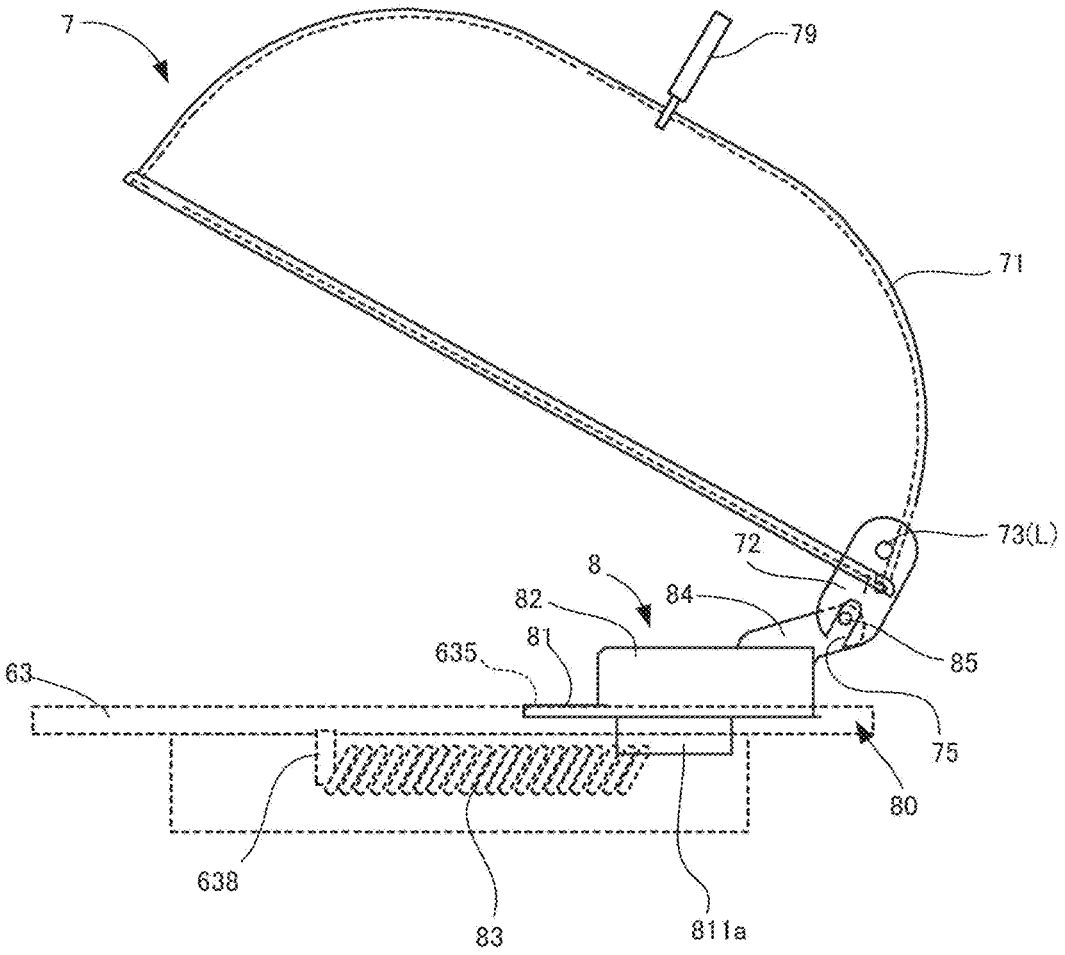
FIG. 13 is a side view of the lid body in the open state and the operating element.

As shown in FIG. 11C, a plurality of protrusions 811 extending in the front-to-rear direction are formed on a lower surface of the main body 81, and these protrusions 811 are fit into the through holes 636 formed in the bottom surface of the recess 635 of the mounting plate 63, as described above. As a result, the main body 81 is able to slide in the front-rear direction while being guided by the protrusions 811 and the through holes 634. As shown in FIG. 4, etc., the above-mentioned coil spring 83 is attached between the central protrusion 811*a* in the left-right direction among the protrusions 811 and an attachment portion 638 formed on the lower surface of the mounting plate 63 at a position frontward of the protrusion 811*a*. The coil spring 83 constantly biases the operating element 8 forward. However, as shown in FIG. 13 described later, the main body 81 of the operating element 8 is disposed in the recess 635 of the mounting plate 63, and a front wall of the recess 635 acts as a stopper. Therefore, the main body 81 is restricted from moving forward by the front wall of the recess 635 although the main body 81 is biased forward by the coil spring 83.

As shown in FIG. 11, protrusions 84 are formed on both sides of the rear end of the support portion 82 to extend obliquely upward toward the rear side. A connecting shaft 85 extending in the left-right direction is formed near the upper end of each protrusion 84, and each connecting shaft 85 is inserted into the notch 75 formed in the arm piece 72 of the cover body 7 and is capable of moving within the notch 75. The connecting shaft 85 is inserted into the notch 75 at a position below the pivot axis L.

Figure 12:
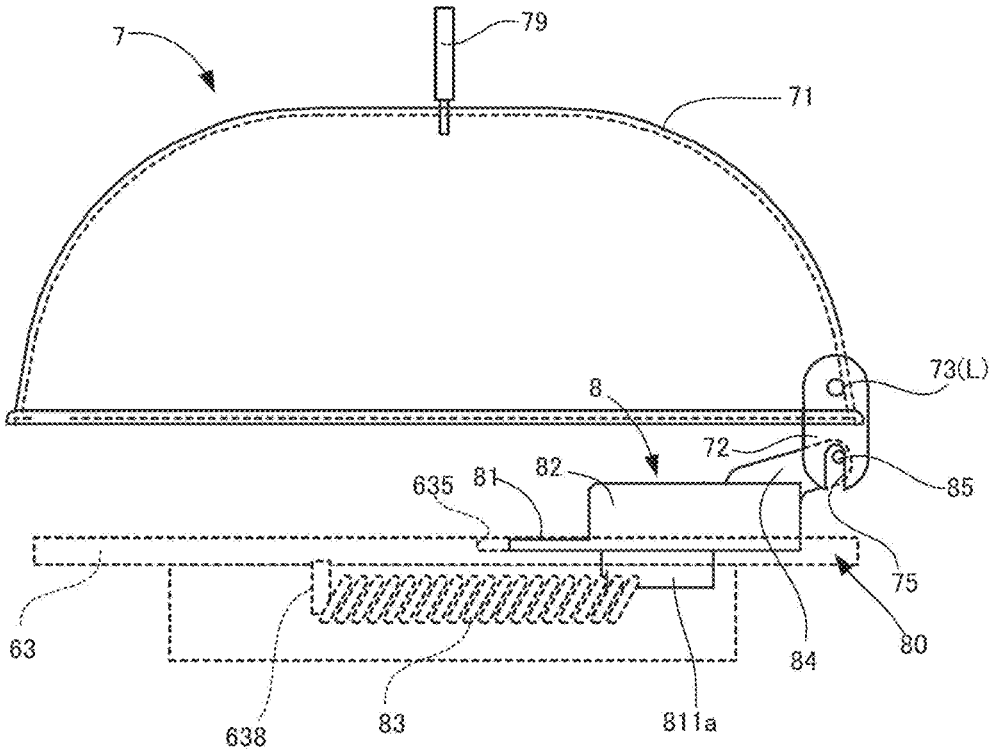
FIG. 12 is a side view of the lid body in the closed state and the operating element.

Next, operation of the lid body by the operating element will be described below. FIG. 12 shows the lid in a closed state, and FIG. 13 shows the lid in an open state. FIGS. 12 and 13, the cover body 7 and the operating element 8 are mainly shown, and for the sake of convenience, the support pieces 67 of the mounting base 6 are omitted.

The operating element 8 is constantly biased forward by the coil spring 83, and therefore, as shown in FIG. 12, the operating element 8 is in contact with the front wall of the recess 635 when no external force is applied to the operating element 8. As a result, the connecting shafts 85 push the lower ends of the arm pieces 72 forward. That is, the connecting shafts 85 press the lower ends of the arm pieces 72 forward at a position below the pivot axis L, so that the lid body 7 rotates upward about the pivot axis L to open. Since the operating element 8 is constantly biased forward by the coil spring 83, the lid body 7 is in the open state as default as shown in FIG. 13.

From this state, when the operating element 8 is moved rearward against the coil spring 83, the connecting shafts 85 push the arm pieces 72 rearward, as shown in FIG. 12. As a result, the lid body 7 is pressed rearward at a position below the pivot axis L, so that the lid body 7 rotates downward about the pivot axis L to be closed as shown in FIG. 12. In this process, the connecting shafts 85 moves upward within the notches 75 of the arm pieces 72.

<5. Usage of the Container>

Next, a method of using the container 5 will be described. First, a staff places food or drink (not shown) such as sushi on the plate body 41 of the plate 4, then holds the circumferential edge of the plate body 41 with his/her hand to place the plate 4 on the opened container 5 on the conveying path 1. That is, from the state shown in FIG. 6, the plate 4 is pushed backward against the mounting plate 63. At this time, the base 42 of the plate 4 is brought into contact with the inner surface 821 of the operating element 8, and the plate 4 together with the operating element 8 is pressed backward. Then, when the base 42 of the plate 4 is engaged with the second inner surface 642 of the stopper 64, the base 42 is held (or set) between the operating element 8 and the stopper 64. During this process, the operating element 8 moves rearward, so that the lid body 7 rotates downward to be closed, as shown in FIGS. 3 and 4. As a result, since the top of the plate 4 is covered with the lid 7, the sushi is protected by the lid 7 and dust and the like are prevented from adhering thereto. However, since the lid 7 is transparent, the sushi inside the container can be seen from the outside. In addition, since the operating element 8 is biased forward by the coil spring 83, the base 42 of the plate 4 is pressed by the operating element 8. Therefore, the base 42 is firmly held between the operating element 8 and the stopper 64. Accordingly, the lid body 7 is maintained in the closed state and will not open accidentally.

The container 5 with the plate 4 is conveyed along the conveying path 1, and a customer removes the plate 4 from the container 5 at the table 31. That is, from the state shown in FIG. 3 and FIG. 4, a finger of a customer is inserted through the notch 76 of the lid body 7, and the plate body 41 is grasped with the finger and pushed upward by the finger. As a result, when the base 42 is released from the stopper 64, the base 42 is pushed forward by the operating element 8. During this process, the operating element 8 moves forward, causing the lid body 7 to rotate upward to open. In this way, the customer can remove the plate 4 from the container 5 while still holding the plate body 41.

<6. Connector>

Figure 14:
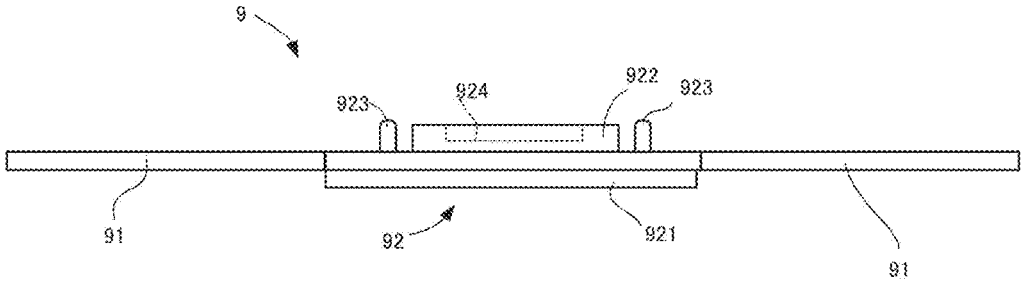
FIG. 14 is a front view of a connector according to a first embodiment.
Figure 15:
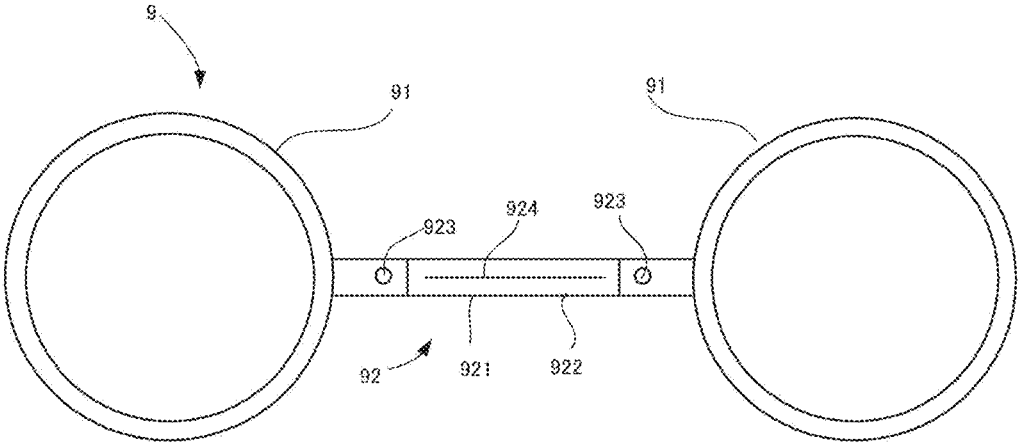
FIG. 15 is a plan view of FIG. 14.
Figure 16:
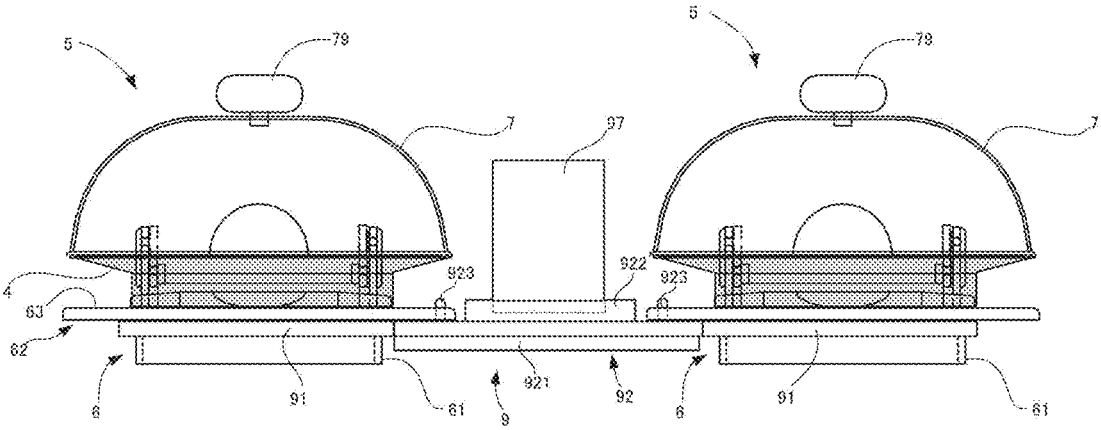
FIG. 16 is a front view of a pair of containers connected by the connector of FIG. 14.
Figure 17:
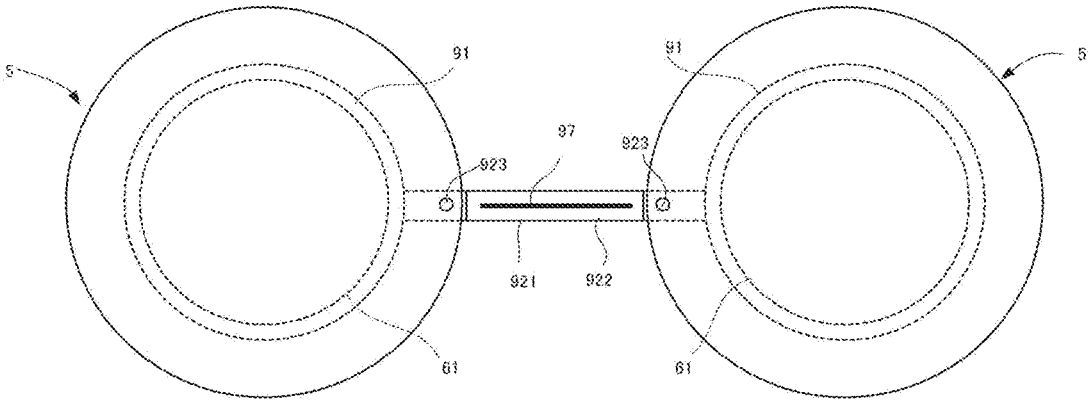
FIG. 17 is a plan view of FIG. 16.

FIG. 14 is a front view of a connector, FIG. 15 is a plan view of FIG. 14, FIG. 16 is a front view of the containers to which the connector is attached, and FIG. 17 is a plan view of FIG. 16. In this embodiment, two adjacent containers 5 are connected by the connector 9 and conveyed along the conveying path 1. As shown in FIGS. 14 and 15, the connector 9 has a pair of attachment portions 91 that are attached to the container 5, and a connecting portion 92 that connects the attachment portions 91 to each other. Each attachment portion 91 is formed in an annular shape and is detachably attached to an outer circumferential surface of the base 61 of the container 5. Therefore, the attachment portion 91 is formed of an elastic material such as rubber, and has an inner diameter smaller than the outer diameter of the base 61 when the attachment portion 91 is not attached to the base 61. When attaching the attachment portion 91 to the base 61, the inner diameter of the attachment portion 91 is expanded, and then the attachment portion 91 is attached to the base 61. As a result, the attachment portion 91 elastically presses against the outer circumferential surface of the base 61 and is fixed to the base 61.

The connecting portion 92 is a member to keep the distance between the two containers 5. More specifically, the connecting portion 92 has a plate-shaped main body portion 921, a fixing portion 922 formed on an upper surface of the main body portion 921, and a pair of protrusions 923 formed on the upper surface of the main body portion 921 on both sides of the fixing portion 922. These portions 921, 922, 923 are formed integrally. The main body portion 921 extends in a rod shape to keep the distance between the two containers 5, and both ends of the main body portion 921 are fixed to the attachment portions. The fixing portion 922 is formed in a rectangular parallelepiped shape, and a slit 924 is formed on an upper surface of the fixing portion 922. A sheet-like or plate-like display member 97 made of paper, resin, or the like is fixedly inserted into the slit 924. The display member 97 displays, for example, at least one of the following: the contents of food or drink housed in the container 5, advertisements (so-called POP advertisements, etc.), and information for customers (for example, gratitude to customers, or information to customers). That is, the display member 97 provides a notification (or a sign) that can be seen by customers. In this case, the display member 97 may be a display medium made of paper or the like, or may be an electronic display made of electronic paper.

The slit 924 is used as a display attaching portion for attaching the display member 97 to the connecting portion 92, and by forming such a display member attaching portion in the connecting portion 92, the display member 97 can be stably attached to the connecting portion 92.

The connecting portion 92 is formed to have an enough length to allow the display member 97 to be attached to the connecting portion 92. In this case, any types of contents can be displayed as long as the contents are visible from the customer seats. For example, taking into account the horizontal length of the display member 97 (at least the length of the lower end), the two containers 5 may be connect to each other with a certain distance therebetween. This ensures a space in the horizontal direction (i.e., the conveying direction of the conveying path) between the containers 5, making it possible to attach the display member 97 to the connecting portion 92.

Each protrusion 923 is fixed to the through hole 69 formed in the mounting plate 63. Accordingly, an attachment angle between the connecting portion 92 and the mounting plate 63 is fixed. Therefore, when the connector 9 is fixed to the containers 5, the distance between the two containers 5 and the angle of the connector 9 with respect to each of the two containers 5 is fixed, and the two containers 5 are conveyed on the conveying path 1 while keeping this fixed state.

The maximum distance between the two containers 5 is not particularly limited, but is preferably 12 cm or less, more preferably 11 cm or less, and even more preferably 10 cm or less, for example. On the other hand, the minimum distance between both containers 5 is not particularly limited, but is preferably 7 cm or more, and more preferably 8 cm or more, for example. The connector 9 is designed to have the above-described distance between the two containers 5. The length of the connector 9 is set based on the outer diameter of the container 5, the width of the conveying path 1, the radius of curvature of a curved path 103 which will be described later, and the like, to allow the two containers 5 to be conveyed smoothly.

In this case, the upper limit of the length of the connecting portion 92 is preferably set such that, for example, the movement range (or the movement trajectory) of a single assembly of the two containers 5 connected by the connecting portion 92 does not exceed a passing area formed by, e.g., a U-shaped conveying path formed of straight paths and a curved path. This is because if the length of the connecting portion 92 is set such that the movement range of the single assembly formed of the two containers 5 connected by connecting portion 92 exceed the passing area formed by the U-shaped conveying path, one of the two containers would come into contact with the outer or inner edge of the passing area when the assembly turns along the curved conveying path, making it difficult for the two containers 5 connected by connecting portion 92 to pass through.

The outer diameter of the container 5 needs to be set, for example, based on the outer diameter of a part of the container that may interfere with the conveying path 1. For example, the outer diameter of the container 5 may be set based on the outer diameter of the base 61 or the mounting portion 62.

Furthermore, if a quick turn mechanism (guides and a conveyor for shortcutting the conveying path) is provided in the conveying path 1, the length of the assembly formed of the two containers 5 connected by the connecting portion 92 may be preferably set such that the movement range of the assembly does not exceed a passing area formed by a path of the quick turn mechanism.

Furthermore, the connector 9 is formed of a material having sufficient rigidity so that the distance between the two containers 5 and the angle of the connector 9 relative to each of the two containers 5 do not change during conveyance. For example, the connector 9 may be made of a resin material or a metal material that is not easily elastically deformed. More specifically, for example, the connector may have a rigidity not to deform when one end of the connecting portion 92 is supported and extended horizontally and when a load of 80*g* or less is applied to the other end of the connecting portion 92. Although the connector 9 does not deform during conveyance, the connector 9 is not a complete rigid body. Therefore, the connector 9 may be allowed to slightly deform when a strong force is applied to the connector 9.

<7. Conveyance of the Containers Connected by the Connector>

Next, conveyance of the two containers 5 connected by the connector 9 will be described. First, as shown in FIGS. 16 and 17, the connector 9 is attached to the containers 5. Next, the pair of containers 5 connected by the connector 9 is placed on the conveying path 1. At this time, both the containers 5 are placed on the conveying path 1, but the connector 9 is not in contact with the conveying path 1 and located at a position above the conveying path 1. In the following, conveyance is performed along the conveyance path 1 shown in FIGS. 18-23. The conveying path 1 has a first straight path 101, a second straight path 102 extending in parallel with the first straight path 101, and a curved path 103 connecting both ends of the straight paths 101, 102 to each other. The containers then travels in the left direction along the first straight path 101, passes through the curved path 103, changes direction, and then travels in the right direction along the second straight path 102. The tables 31 face the first straight path 101 and the second straight path 102. Moreover, the conveying path 1 is positioned slightly lower than other surrounding bases. Therefore, the conveying path 1 is disposed in an area between an outer edge 201 and an inner edge 202. However, although the mounting plate 63 is located higher than the other surrounding bases and does not come into contact with the other bases during conveyance, the base 61 may come into contact with the outer edge 201 or the inner edge 202 if the base 61 is not conveyed properly. For ease of explanation, a front container of the two containers will be referred to as a first container 501 and a rear container of the two containers will be referred to as a second container 502. Moreover, the locations indicated by black squares in each of the containers 501 and 502 are positions where the notches 76 are formed, and indicate a front side of each of the containers 501 and 502.

Figure 18:
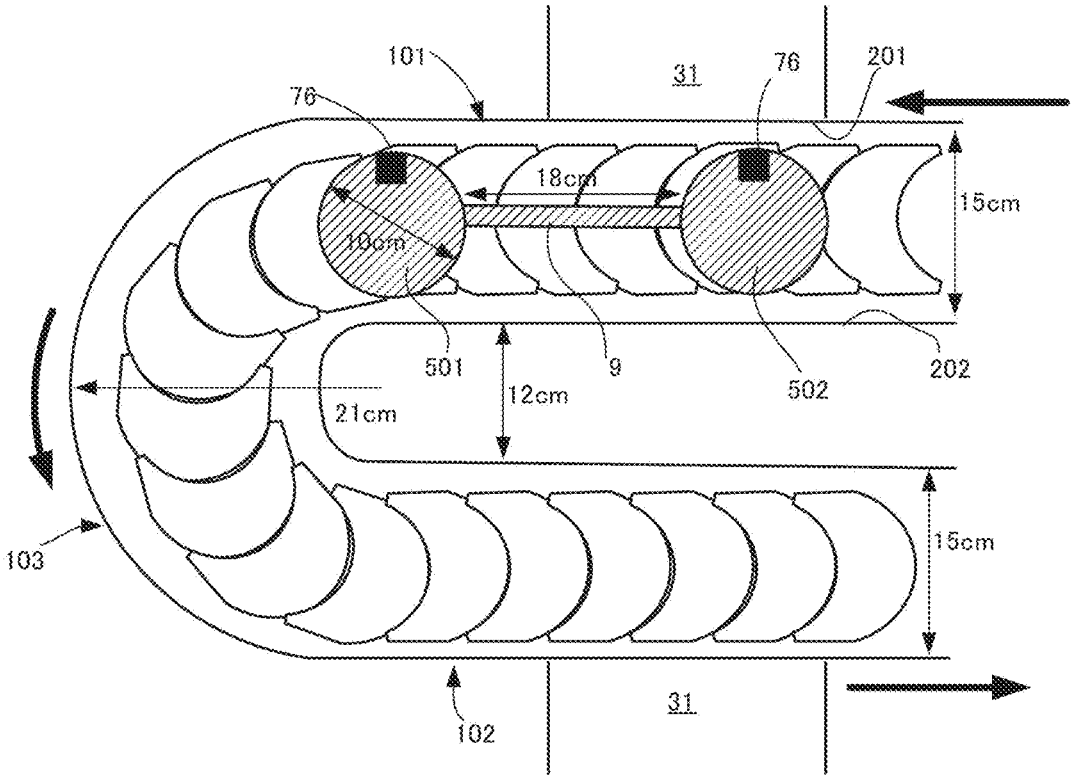
FIG. 18 is a plan view showing a process in which a pair of containers connected by the connector of FIG. 14 are conveyed along the conveying path.

In the following, as an example of the containers 501, 502, the width of the straight paths 101, 102 and the curved path 103 is 15 cm, the radius of curvature of the curved path 103 is 21 cm, the distance between the first and second straight paths 101, 102 is 12 cm, the outer diameter of the base 61 of each container 5 is 10 cm, the outer diameter of the mounting plate 63 is 16 cm, and the distance between the containers (the distance between the mounting plates 63) is 12 cm (18 cm in FIG. 18 indicates the distance between the bases 61:12 cm+3 cm+3 cm). The speed of the conveying path 1 is 80 to 100 mm/sec. However, these are merely examples, and as described above, each dimension can be changed as appropriate so that both the containers 501, 502 can move smoothly along the conveying path 1 in a connected state. FIGS. 18 to 23, the portions designated by reference numerals 501 and 502 indicate the bases 61 of the respective containers 501 and 502.

Figure 19:
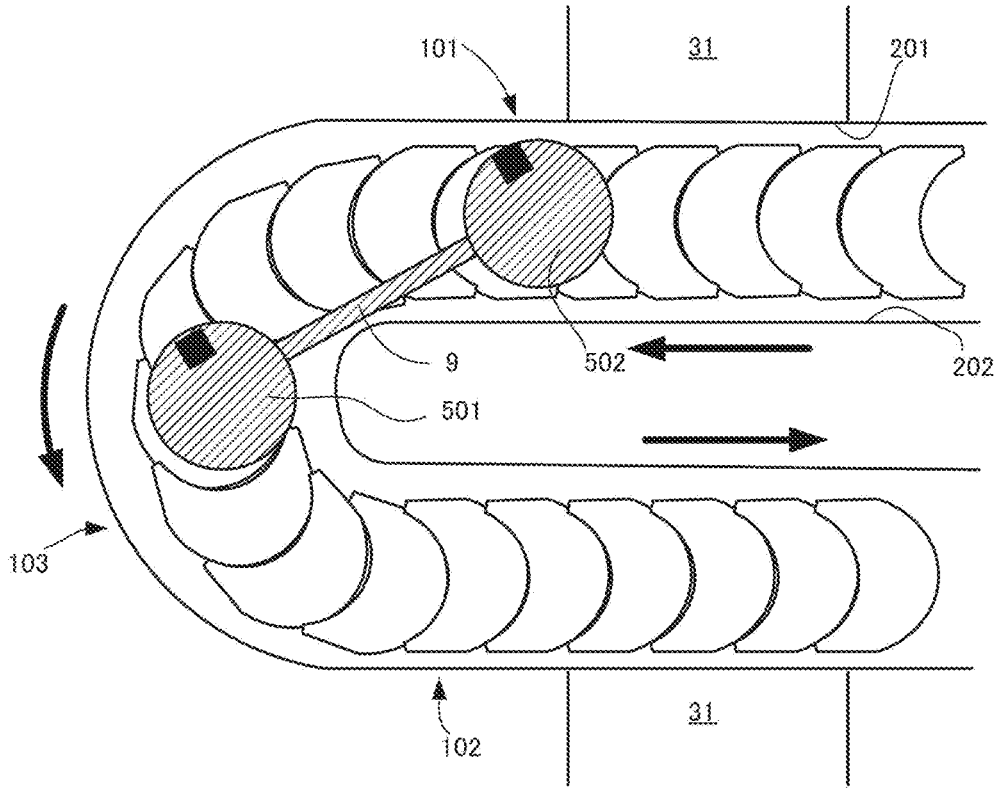
FIG. 19 is a plan view showing a process in which a pair of containers connected by the connector of FIG. 14 are conveyed along the conveying path.

First, as shown in FIG. 18, both containers 501 and 502 move to the left along the first straight path 101. At this time, the front portions of both the containers 501 and 502 face the table 31. Then, as shown in FIG. 19, when the first container 501 reaches the curved path 103, the connector 9 follows the first container 501 while changing its orientation. Then, the second container 502 moves along the first straight path 101 while rotating slightly on the first straight path 101.

Figure 20:
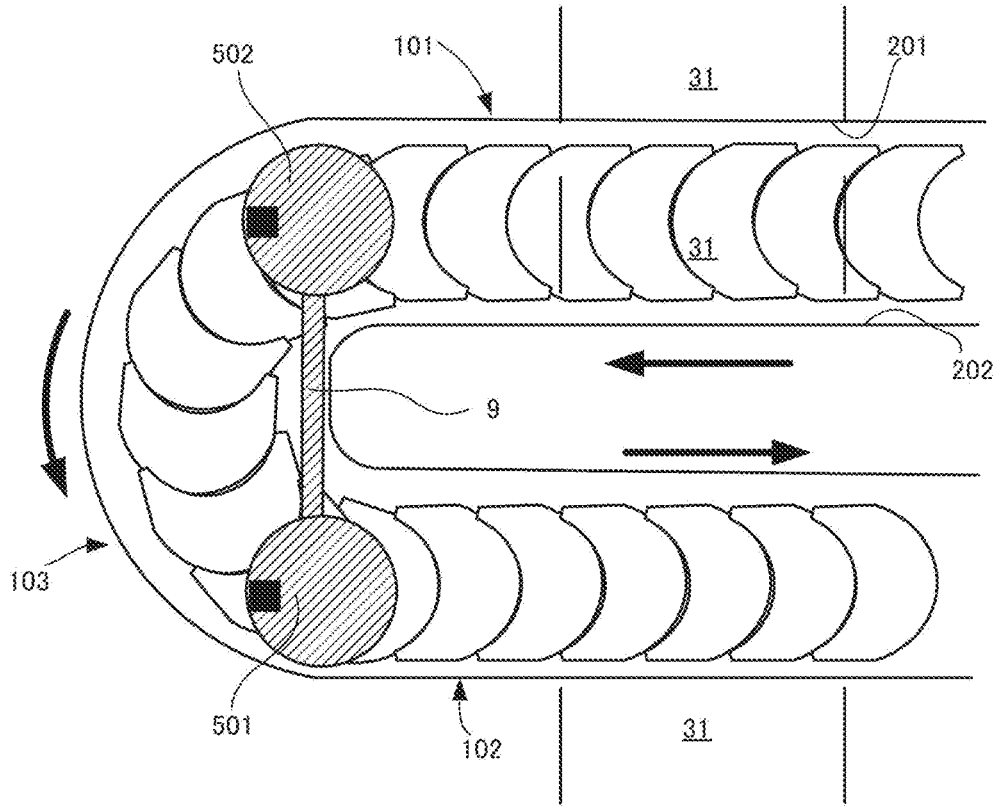
FIG. 20 is a plan view showing a process in which a pair of containers connected by the connector of FIG. 14 are conveyed along the conveying path.
Figure 21:
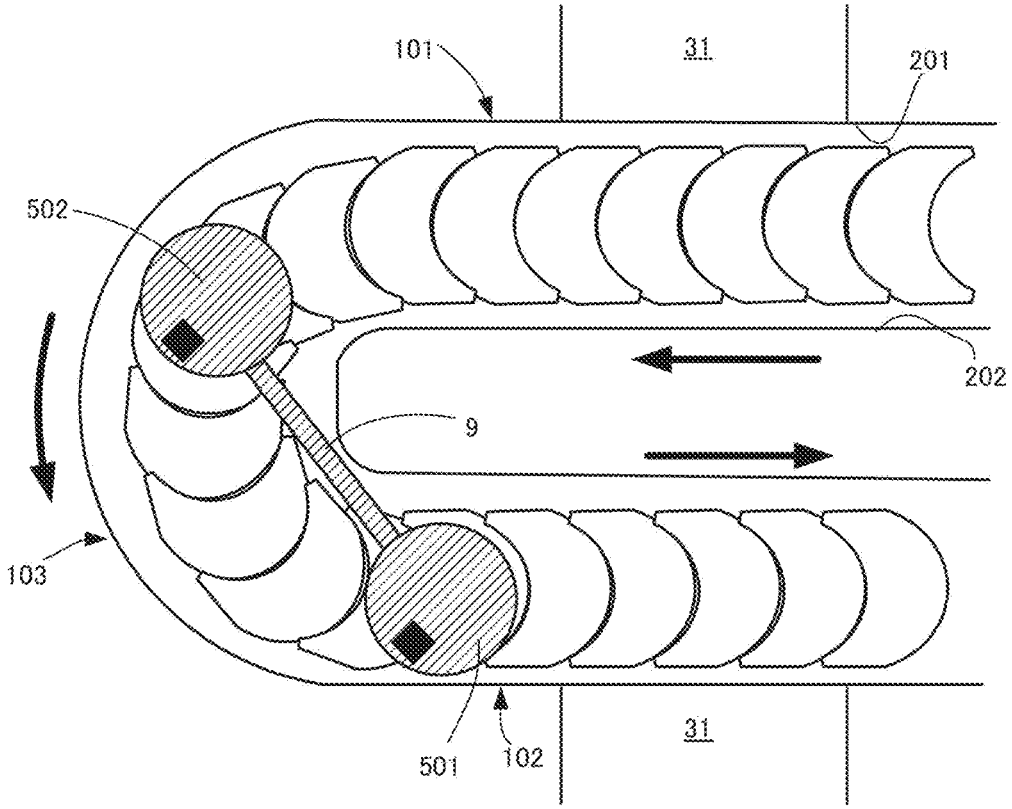
FIG. 21 is a plan view showing a process in which a pair of containers connected by the connector of FIG. 14 are conveyed along the conveying path.
Figure 22:
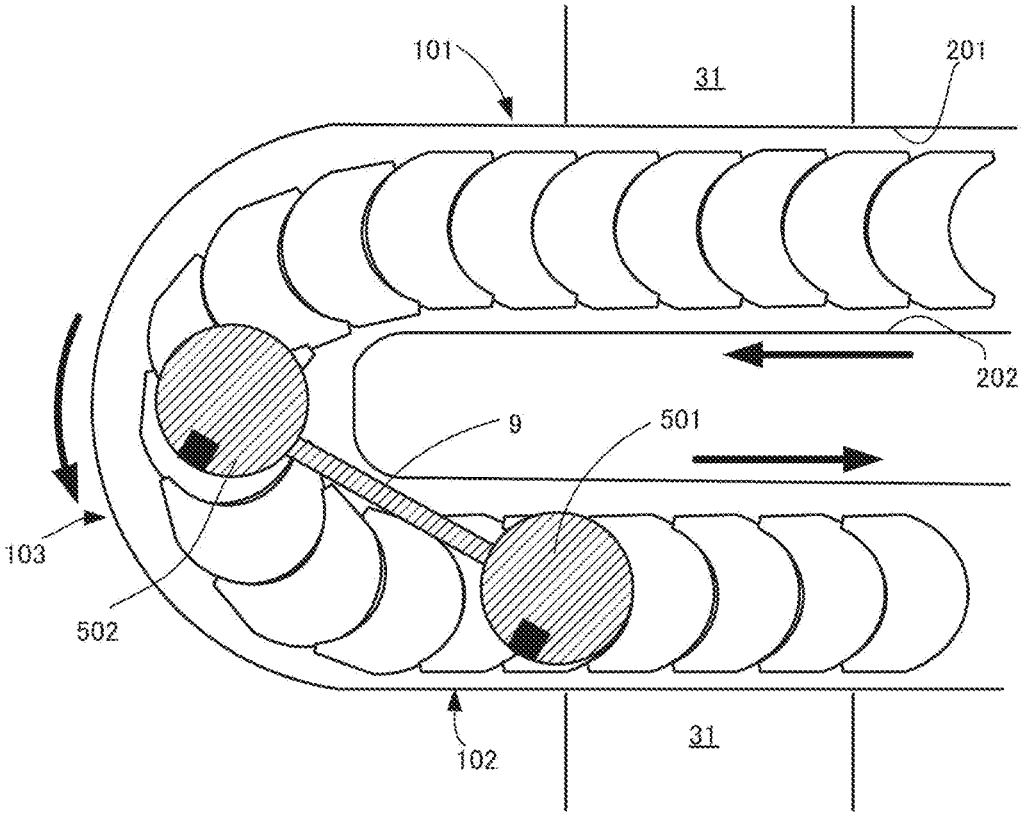
FIG. 22 is a plan view showing a process in which a pair of containers connected by the connector of FIG. 14 are conveyed along the conveying path.
Figure 23:
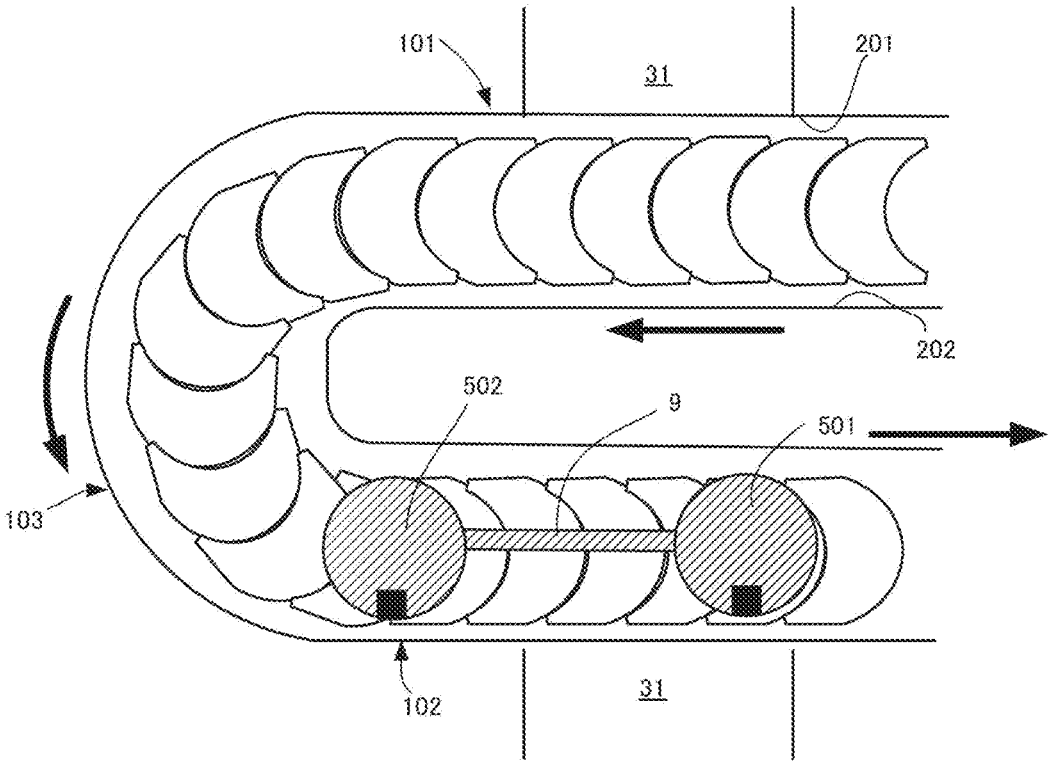
FIG. 23 is a plan view showing a process in which a pair of containers connected by the connector of FIG. 14 are conveyed along the conveying path.

As shown in FIG. 20, when the first container 501 moves to the downstream side of the curved path 103, the second container 502 reaches the curved path 103. Then, as shown in FIGS. 21 and 22, when the first container 501 reaches the second straight path 102, the connector 9 follows the first container 501 while changing its orientation. Then, the second container 502 also moves along the curved path 103 while rotating slightly on the curved path 103. Thereafter, as shown in FIG. 23, the containers 501 and 502 enter the second straight path 102 and move to the right. At this time, the front portions of the containers 501 and 502 face the table 31.

<8. Features>

As described above, the container 5 and the connector 8 according to the present embodiment my provide following advantageous effects.

(1) The two containers 501, 502 are connected by the connector 9, and the display member 97 is attached to the connector 9. Therefore, through the display member 97, customers can be notified of information on a food or drink in the container 5 or be advertised. In this case, for example, it is easy for customers to recognize the relation between the displayed information and the food or drink in the container 5.

(2) The two containers 501 and 502 are connected by the connector 9 and the distance between the containers and the angle of the connector 9 with respect to each of the two containers are fixed, so that the front surfaces of the two containers 501 and 502 always face the table 31 during conveyance on the conveying path. This makes it easier for customers eating at the table 31 to remove the plate 4 from the container 5.

In addition, the display member 97 attached to the connector 9 always faces the table 31, so that it is easy for customers to see the display member 97, thereby enhancing advertising effects.

Figure 24:
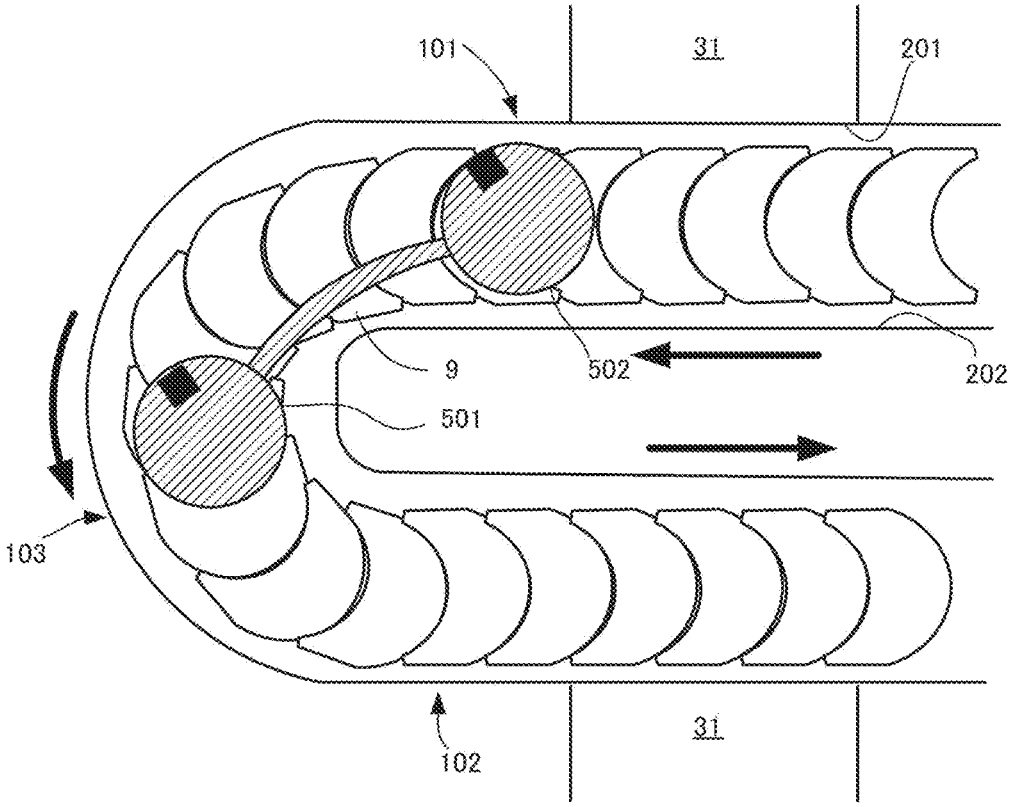
FIG. 24 is a plan view showing the connector when the connector is elastically deformed.

(3) Since the connector 9 is made of a rigid material, even if there is a certain distance between the two containers 501, 502, the containers 501, 502 can be conveyed while keeping the fixed distance therebetween and the angle of the connector 9 relative to the containers. On the other hand, if the connector 9 is made of an elastically deformable material, there would be a risk that the connector 9 may bend during conveyance along the curved path 103 as shown in FIG. 24. If the connector 9 is bent, the positional relationship between the two containers 501 and 502 on the conveying path 1 change, and as a result, the containers 501 and 502 would be unable to pass through the conveying path 1 and may stop on the conveying path 1. In contrast, when the connector 9 having rigidity is used as described in this embodiment, the positional relationship between the two containers 501, 502 can be maintained, and therefore the two containers 501, 502 can be conveyed stably.

In addition, when the connector 9 having rigidity is used, the connector 9 also suitably works at a quick turn mechanism (guides and a conveyor for shortcutting the conveying path 1) disposed in the conveying path 1. In this case, the positional relationship between the two containers 501, 502 would be likely to change due to the difference in conveying speed between the conveyor of the quick turn mechanism and the conveyor of the conveying path 1. Furthermore, steps formed at borders between the conveyor of the quick turn mechanism and the conveyor of the conveying path 1 would cause problems such as interference with the movement of the containers 501, 502. Therefore, by using the rigidly made connector 9, a driving force generated by the movement of the second container 502 can be used to move the first container 501 forward, or conversely, the second container 502 can be pulled via the connector 92 as the first container 501 moves, allowing the two connected containers 501, 502 to move smoothly even if there are differences in conveying speeds or steps.

Furthermore, when the connector 9 having rigidity is used, it is possible to prevent the connector 9 from bending during conveyance at the curved path 103, which would otherwise cause the shape of the display member 97 attached to the connector 9 to be changed. This allows the information to be displayed on the display member appropriately to customers.

B. Second Embodiment

Next, a second embodiment of a connector of the present disclosure will be described with reference to FIGS. 25-28. It should be noted that containers and the like other than the connector are the same as in the first embodiment, and therefore the detailed description will be omitted.

Figure 25:
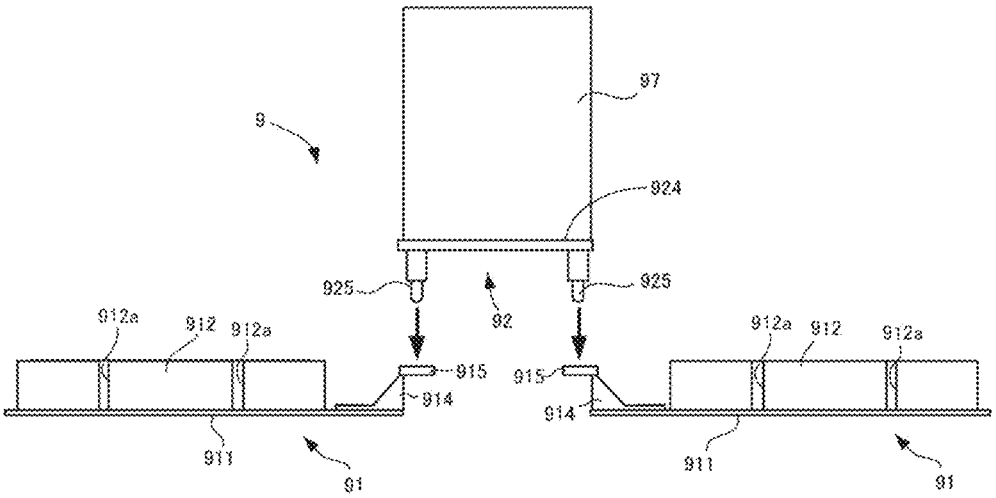
FIG. 25 is a front view of the connector of the first embodiment.
Figure 26:
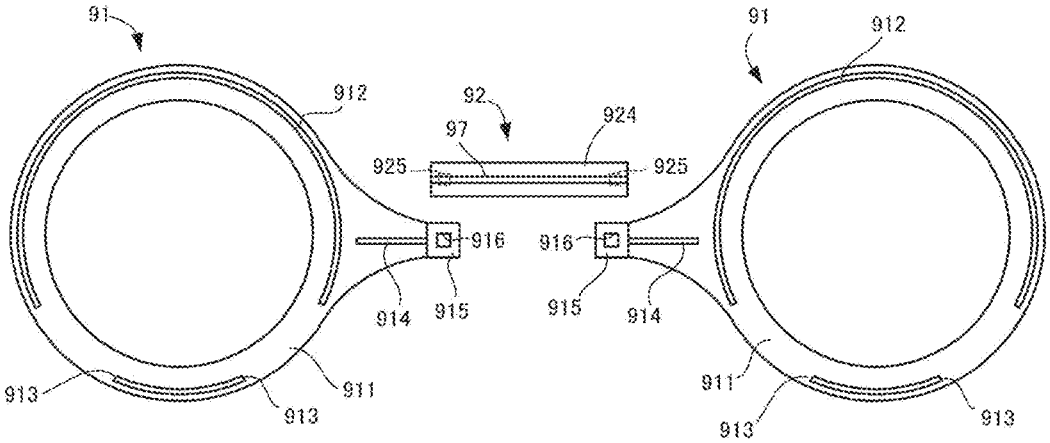
FIG. 26 is a plan view of FIG. 25.
Figure 27:
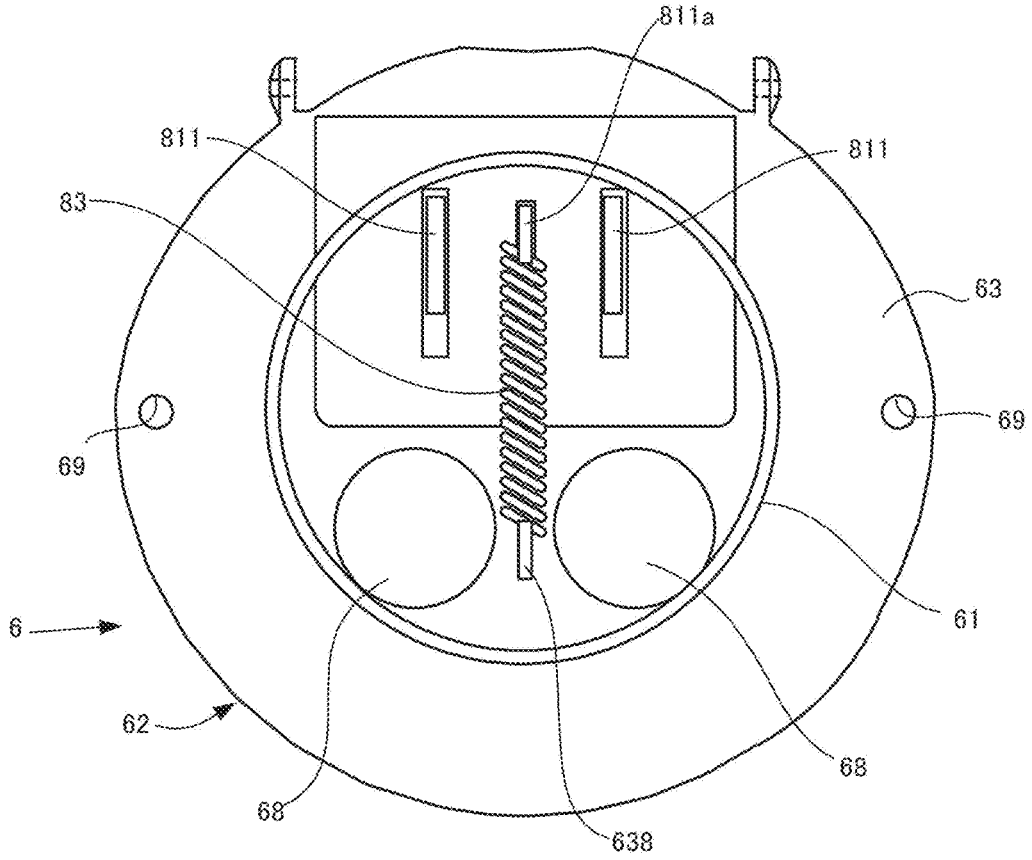
FIG. 27 is a bottom view of a mounting base of the container.
Figure 28:
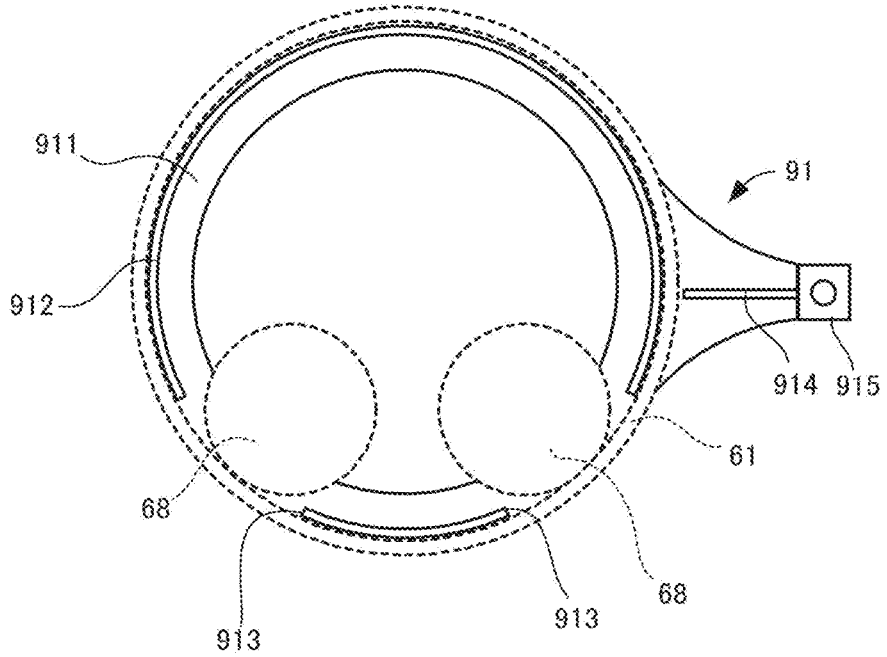
FIG. 28 is a plan view showing the fixing between attachment portions of the connector and the containers.
Figure 29:
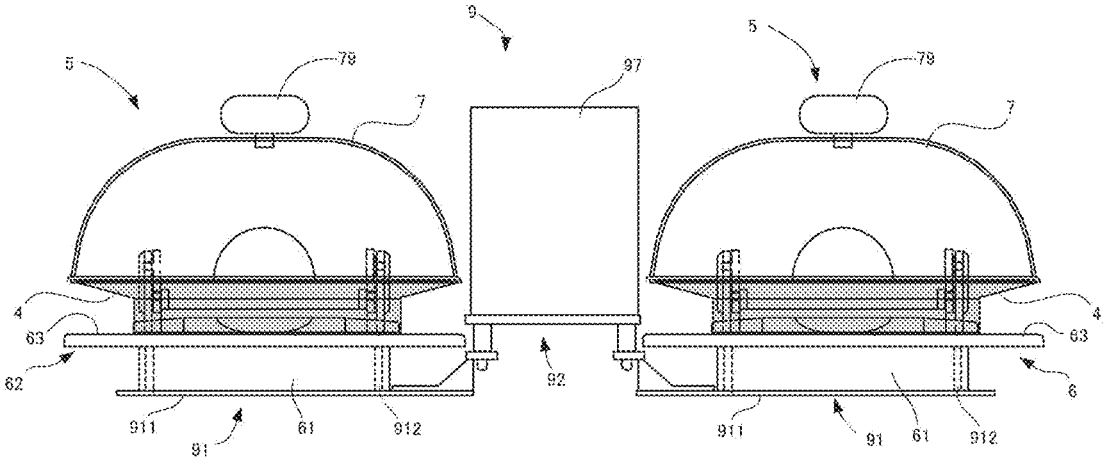
FIG. 29 is a front view of a pair of containers connected by the connector of FIG. 25.
Figure 30:
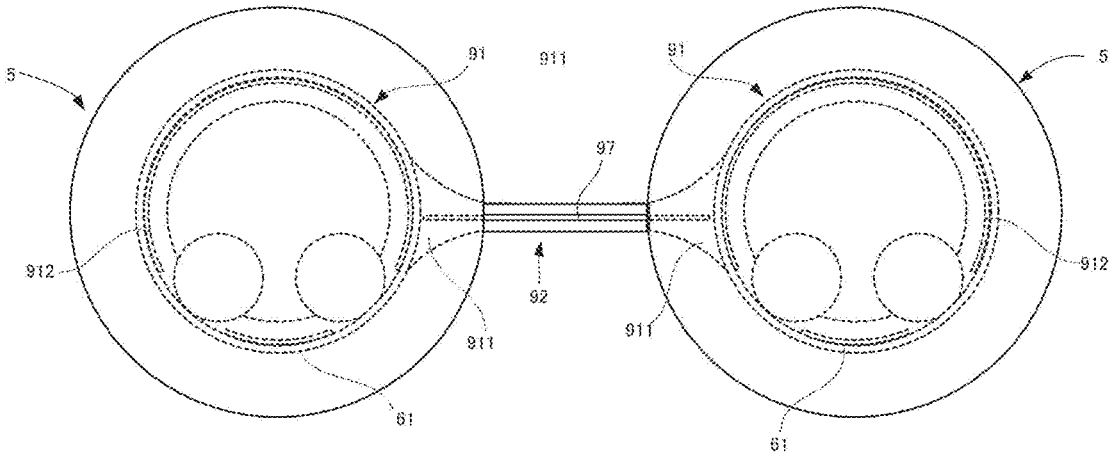
FIG. 30 is a plan view of FIG. 29.

FIG. 25 is a front view of the connector, FIG. 26 is a plan view of FIG. 25, FIG. 27 is a front view of containers to which the connector is attached, and FIG. 28 is a plan view of FIG. 27. The connector according to this embodiment differs from the first embodiment in that attachment portions 91 and a connecting portion 92 are separately formed.

<1. Overview of the Connector>

As shown in FIGS. 25 and 26, the connector 9 has a pair of attachment portions 91 and the connecting portion 92. The attachment portions 91 have the same structure as each other. The attachment portion 91 has a plate-shaped board 911, a first support portion 912 and a second support portion 913 that are disposed on an upper surface of the board 911, a standing portion 914 that stands up on the upper surface of the board 911, and a fixing portion 915 provided at an upper end of the standing portion 914.

The board 911 is formed in an annular shape and has a portion protruding in a radial direction. The support portion 912 having a cylindrical shape is disposed around the circumferential edge of the board 911, and slits (i.e., anti-rotation portions) **912*a* are formed on a front side of the support portion 912. The slits 912*a* are located at positions symmetrical with respect to the center of the support portion 912. The first support portion 912 is housed in the base 61 of the container 5. Therefore, the outer diameter of the support portion 912 is substantially the same as the inner diameter of the base 61**.

The standing portion 914 is formed in a plate shape and protrudes upward from the protruding portion of the base 911. A fixing portion 915 is attached to the outermost upper end of the standing portion 914. The fixing portion 915 is formed in a rectangular plate shape, and has a through hole 916 in plan view at the center of the fixing portion 915.

The connecting portion 92 has a thinner main body 924 and projections 925 that each has a rectangular column shape. The projections 925 protrude downward from both ends of the lower surface of the main body 924. The protrusions 925 are inserted into the through holes 916 of the attachment portions 91. The above-mentioned display member 97 is disposed on the upper surface of the main body 924. The distance between the two containers 5 described in the first embodiment is approximately equal to the length of the main body 924. Furthermore, material of the connector 9 in this embodiment may be the same as that in the first embodiment.

<2. Usage of the Connector>

Next, a method of using the connector 9 will be described. First, fixing between the base 61 of the container 5 and the attachment portion 91 will be described with reference to FIGS. 27 and 28. FIG. 27 is a bottom view of the mounting portion of the container. As described above, the cylindrical base 61 is provided on a lower surface of the mounting plate 63 of the mounting portion 62. As described above, the coil spring 83 extending in the front-rear direction is provided in the internal space of the base 61. A pair of weights 68 are provided on the lower surface of the mounting plate 63 so that the coil spring 83 is interposed between the pair of weights. The weights 68 are used to stably position the container 5 on the conveying path 1.

Each weight 68 is formed in a cylindrical shape. The weights are provided at two positions in a front side area of the internal space of the base 61 to be symmetrical with respect to the center of the base 61. Moreover, each weight 68 is provided to be in contact with an inner wall surface of the base 61.

As shown in FIG. 28, when the attachment portion 91 is attached to the base 61, the support portion 912 of the attachment portion 91 comes into contact with the inner wall of the base 61. At this time, a part of each weight 68 enters each of a pair of slits 912*a* formed in the support portion 912. Accordingly, the container 5 is prevented from rotating relative to the attachment portion 91.

Next, each protrusion 925 of the connecting portion 92 is inserted into the through hole 916 of the fixing portion 915 of each attachment portion 91. As described above, each protrusion 925 is formed in a square-column shape, and the through hole 916 is formed in a rectangular shape in plan view. Thus, the protrusions 925 are unable to rotate with respect to the through holes 915. Accordingly, the connecting portion 92 is fixed to each attachment portion 91 without change in angle relative to the attachment portions. As a result, the two containers 5 are connected to each other via the connector 9. Thereafter, the containers 5 and the connector 9 are conveyed along the conveying path 1 in the same manner as in the first embodiment.

According to the above-described configuration, the container 5 is attached to the attachment portion 91 by placing the container 5 on the attachment portion 91. Therefore, the attachment work of the attachment portion 91 can be easily performed. In the second embodiment, the base 61 may be placed on the upper surface of the attachment portion 91.

In this manner, in the present embodiment, the attachment portions 91 and the connecting portion 92 are separately formed. Accordingly, by preparing the connecting portion 92 in various version, the connector 9 can be formed by replacing only the connecting portion 92. For example, by preparing various types of the connecting portions 92, such as connecting portions 92 with the main body 924 having different lengths, connecting portions 92 with display members 97 having different shapes, etc., the common attachment portions 91 can be used.

C. Third Embodiment

Next, a third embodiment of a connector of the present disclosure will be described with reference to FIGS. 31-36. It should be noted that the container and the like other than the connecting portion of the connector are the same as those in the second embodiment, and therefore description thereof will be omitted.

Figure 31:
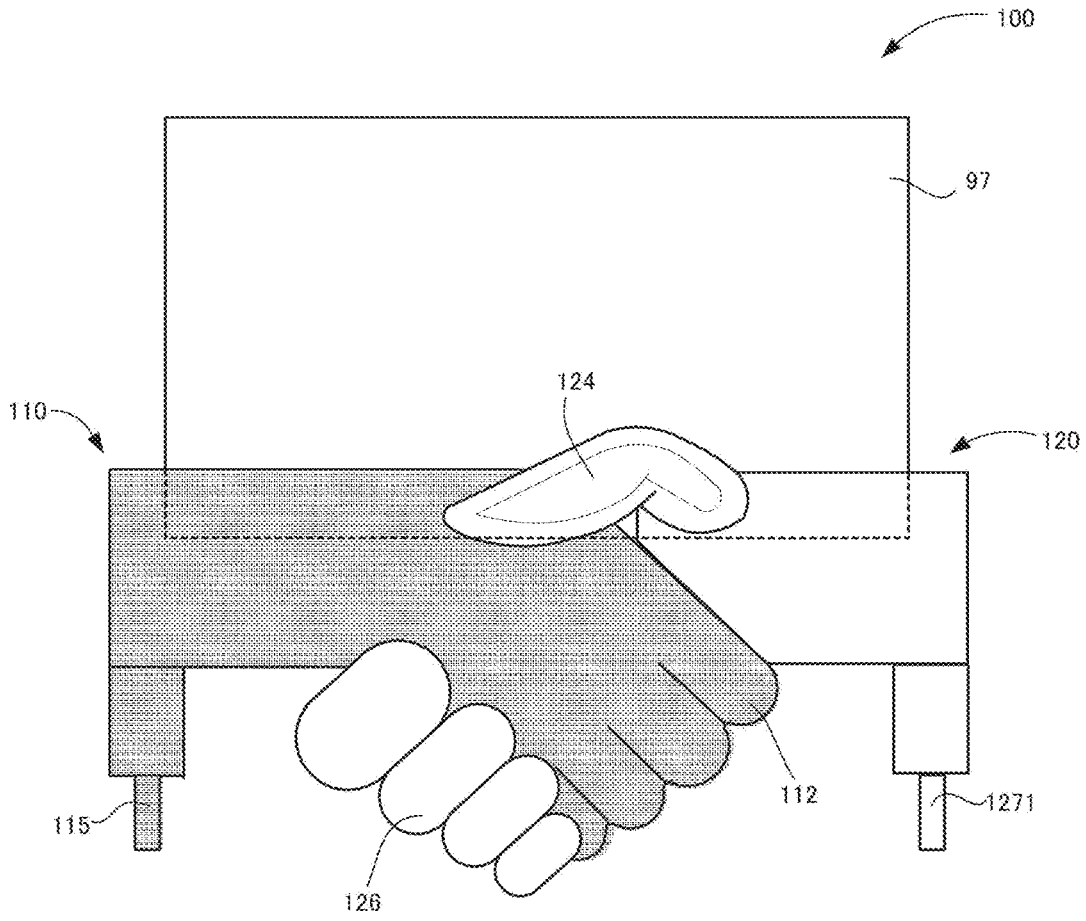
FIG. 31 is a front view of a connecting portion according to a third embodiment.

FIG. 31 is a front view of the connector. The connector according to this embodiment differs from the second embodiment in that the connector 100 is configured to be separable.

<1. Overview of the Attachment Portion>

As shown in FIG. 31, the connecting portion 100 in this embodiment is configured to have a shape of two hands shaking hands. The above-mentioned display member 97 can be attached to the connecting portion 100. The connecting portion 100 includes a first portion 110 and a second portion 120. The first portion 110 and the second portion 120 are colored in different colors as illustrated in FIG. 31. Each portion will be explained below.

<2. The First Portion>

Figure 32A:
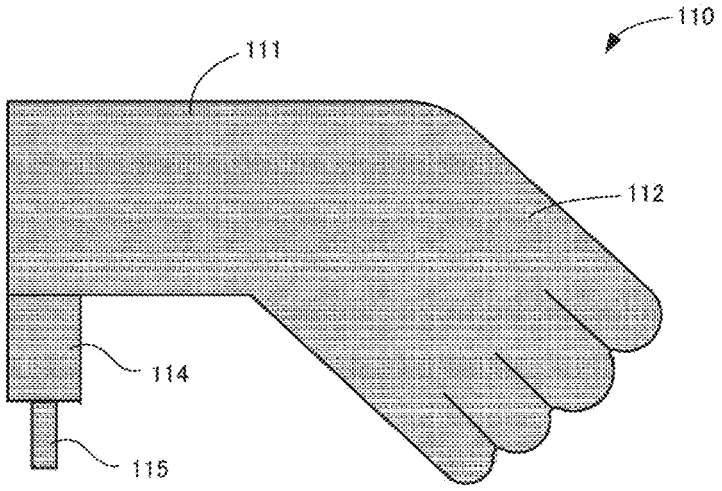
FIG. 32A is a front view of a first portion.
Figure 32B:
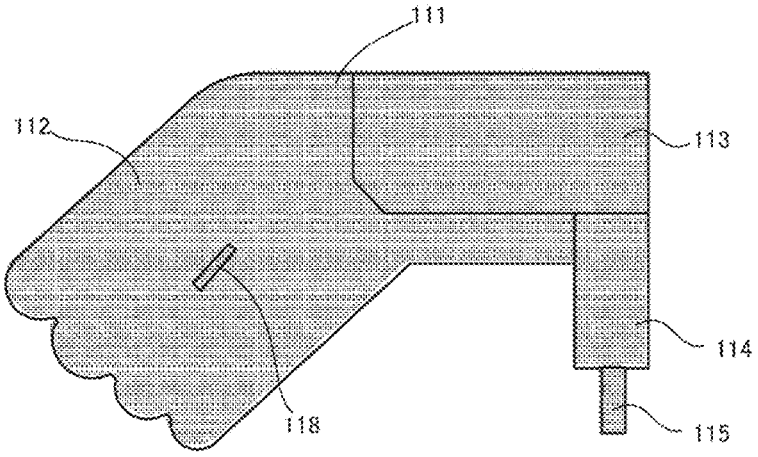
FIG. 32B is a rear view of the first portion.
Figure 32C:
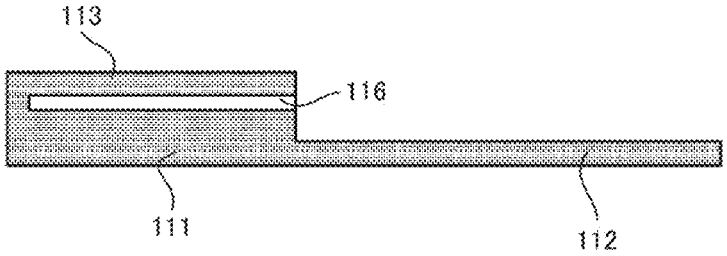
FIG. 32C is a plan view of the first portion.

FIG. 32A is a front view of the first portion, FIG. 32B is a rear view of the first portion, and FIG. 32C is a plan view of the first portion. As shown in FIG. 32, the first portion 110 includes a base 111 formed in a rectangular plate shape, a plate-shaped insertion portion 112 extending diagonally downward from the base 111 to the right (towards the second portion 120), a support portion 113 provided on a rear surface of the base 111, and a fixing portion 114 extending downward from the support portion 113. These portions 111, 112, 112, 114 are integrally formed.

The tip end of the insertion portion 112 is formed in a shape of four fingers except the thumb. The insertion portion 112 is inserted into the second portion 120 to fix the first portion 110 to the second portion 120. As shown in FIG. 32B, a recess 118 is formed on the rear surface of the insertion portion 112, and an engagement portion 1281 of the second portion 120, which will be described later, fits into the recess 118. The support portion 113 is formed in a rectangular parallelepiped shape, and a slit 116 is formed on the upper surface thereof to extend in the left-right direction. The slit 116 opens to the right (toward the second portion 120). A display member 97 is inserted into the slit 116, as will be described later.

The fixing portion 114 is formed in a rectangular parallelepiped shape extending in a vertical direction. The fixing portion 114 is attached to one of the attachment portions 91. For this reason, a protrusion 115 similar to the protrusion 925 described in the second embodiment is formed at the lower end of the fixing portion 114.

<3. Second Portion>

Figure 33A:
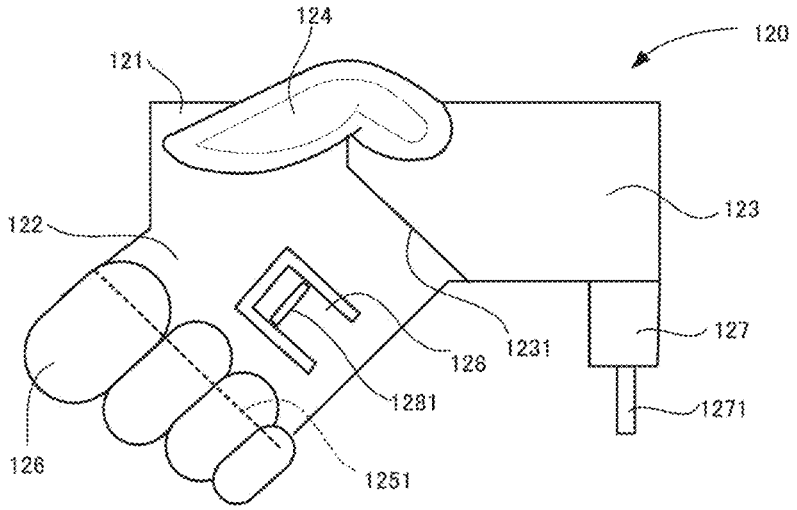
FIG. 33A is a front view of a second portion.
Figure 33B:
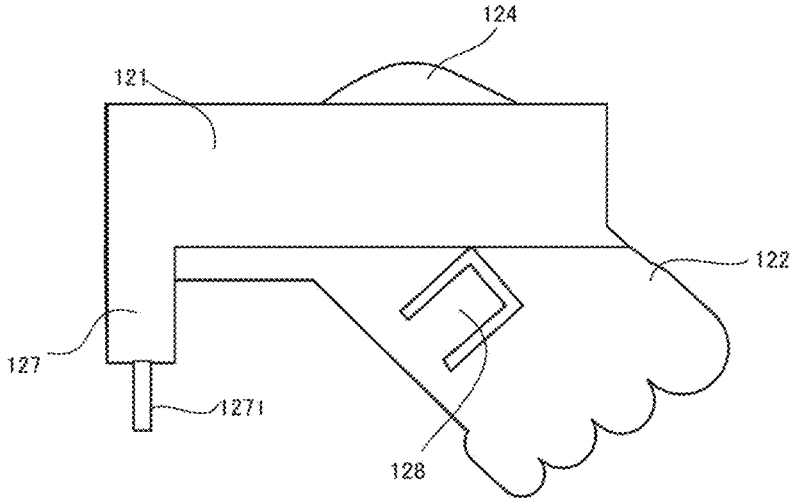
FIG. 33B is a rear view of the first portion.
Figure 33C:
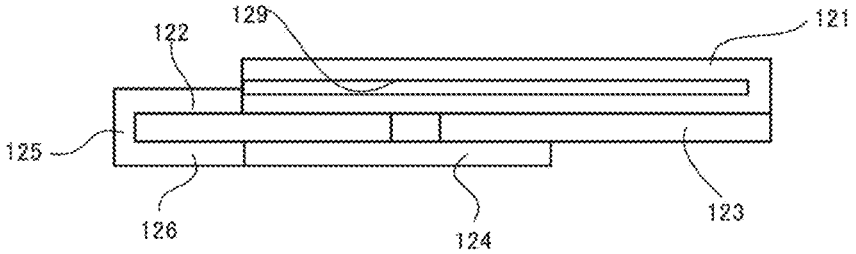
FIG. 33C is a plan view of the first portion.

FIG. 33A is a front view of the second portion, FIG. 33B is a rear view of the second portion, and FIG. 33C is a plan view of the second portion. As shown in FIGS. 33A-33C, the second portion 120 includes a rectangular base 121, a plate-shaped receiving portion 122 extending diagonally downward from the left side of the base 121 (i.e., toward the first portion 110), and a fixing portion 127 extending downward from the base 121. These portions 121, 122, 127 are integrally formed. The front surfaces of the base 121 and the receiving portion 122 form as a single surface.

The base 121 is formed in a rectangular parallelepiped shape, and has a slit 129 formed on the upper surface thereof to extend in the left-right direction. The slit 129 opens to the left (toward the first portion 110). The display member 97 is inserted into the slit 129, as will be described later. Furthermore, a plate-shaped front portion 123 is provided on the right side of the front surface of the base 121. The thickness of this front portion 123 is approximately the same as the thickness of the insertion portion 112 of the first portion 110. Furthermore, a left edge 1231 of the front portion 123 extends downward and obliquely to the right. The extending direction of the left edge 1231 is an insertion direction of the insertion portion 112. A plate-shaped first pressing portion 124 is provided at the upper end on the left side of the front portion 123. The first pressing portion 124 is provided to cover the upper side of the base portion 121 and has a shape of a thumb.

A protrusion 125 that protrudes forward is provided on the lower end edge of the receiving portion 122, and a second pressing portion 126 is disposed to extend from the protrusion 125 toward the upper right. The second pressing portion 126 is formed in a shape of four fingers except the thumb. As a result, a space is formed between the receiving portion 122 and the second pressing portion 126 by the protrusion 125, and the insertion portion 112 is inserted into this gap. Therefore, a right edge 1251 of the protrusion 125 extends downward and obliquely to the right. The extending direction of the left edge 1231 is an insertion direction for the insertion portion 112. Therefore, the insertion portion 112 inserted into the receiving portion 122 is covered by the first pressing portion 124 and the second pressing portion 126.

A U-shaped through hole is formed in the receiving portion 122, and a portion of the receiving portion 122 surrounded by the through hole constitutes a deformation portion 128 that is elastically deformable. Further, a protruding engagement portion 1281 is formed on the front surface of the deformation portion 128, and the engagement portion 1281 is formed to be fit into the recess 118 of the insertion portion 112.

The fixing portion 127 is formed in a rectangular parallelepiped shape extending in a vertical direction. The fixing portion 114 is attached to one of the attachment portions 91. Therefore, a protrusion 1271 similar to the protrusion 925 described in the second embodiment is provided at the lower end of the fixing portion 127.

<4. Method of Fixing the First Portion and the Second Portion>

Figure 34:
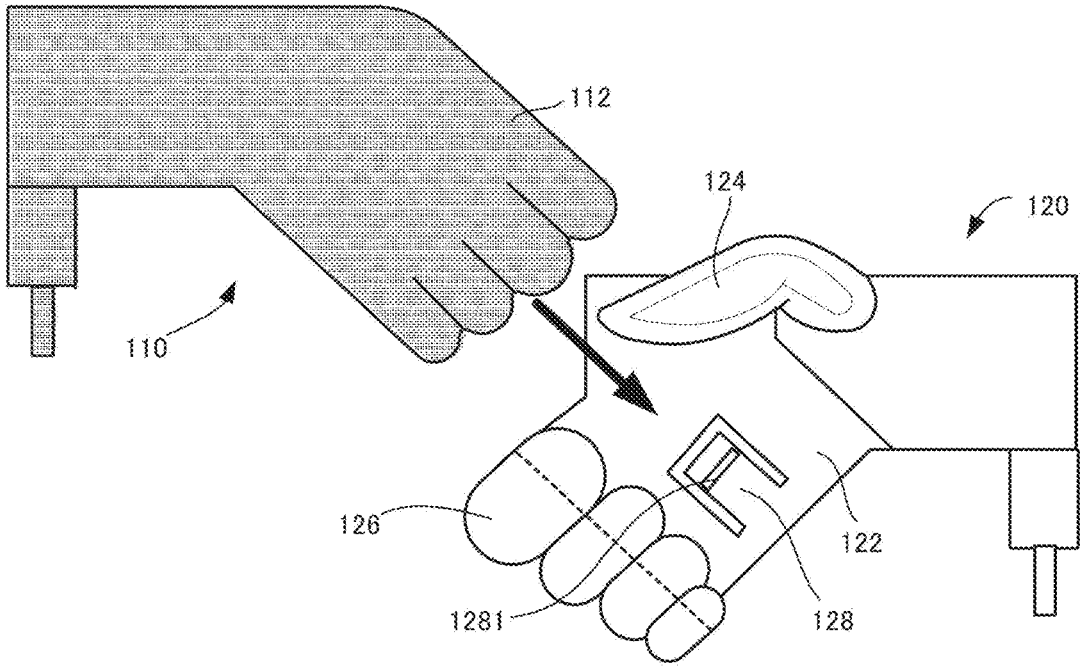
FIG. 34 is a front view showing a process of fixing the first portion and the second portion.

Next, a method for fixing the first portion 110 and the second portion 120 will be described. FIG. 34 is a front view showing the process of fixing the two portions, FIG. 35 is a plan view after fixing, and FIG. 36 is a rear view after fixing.

To fix the first portion 110 to the second portion 120, as shown in FIG. 34, the insertion portion 112 of the first portion 110 is inserted diagonally downward to the right into the space between the front surface of the receiving portion 122 of the second portion 120 and the first and second pressing portions 124, 126. At this time, the deformation portion 128 of the second portion 120 elastically deforms, and the engagement portion 1281 is fit into the recess 118. As a result, as shown in FIG. 31, the first portion 110 and the second portion 120 are fixed to each other to form a shape of shaking hands.

Figure 35:
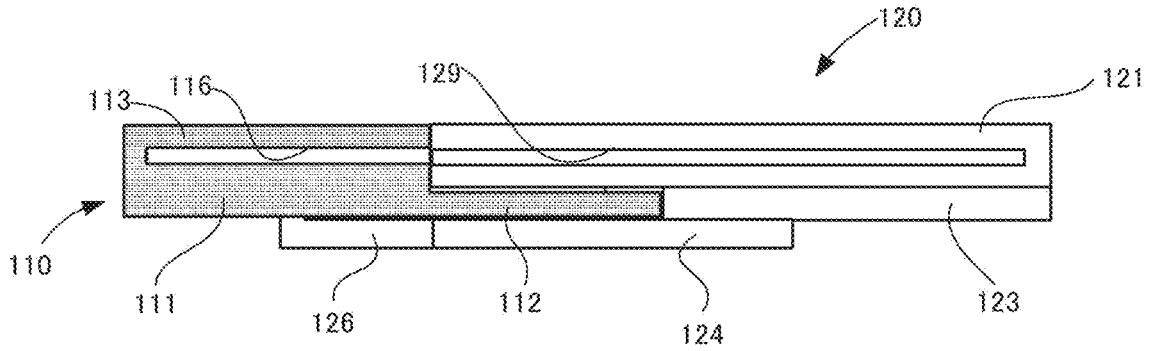
FIG. 35 is a plan view of the first and second portions after fixed together.
Figure 36:
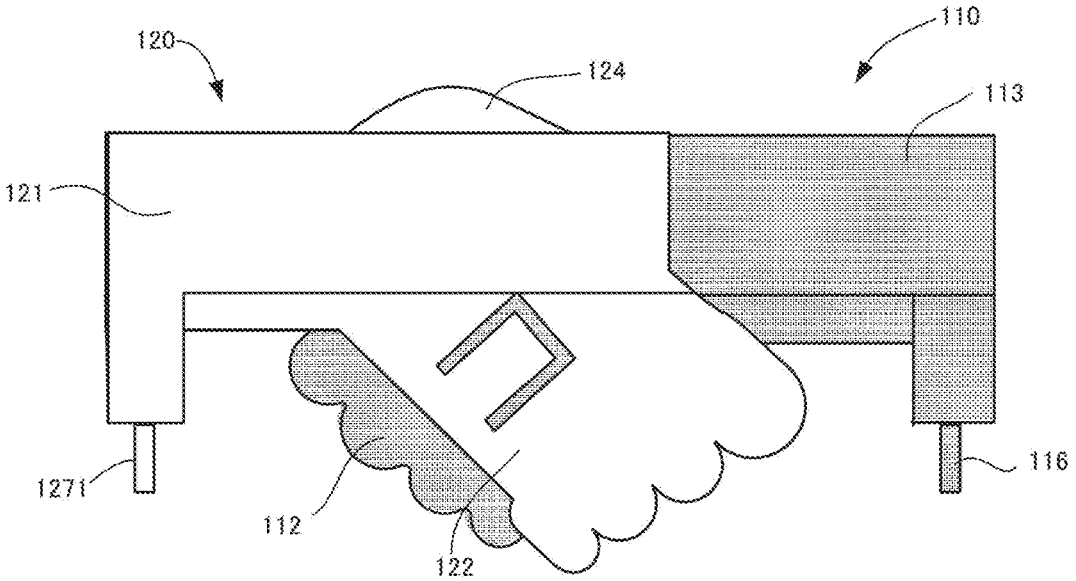
FIG. 36 is a rear view after the first and second portions are fixed together.

After fixing, as shown in FIG. 35, the slit 116 of the first portion 110 and the slit 129 of the second portion 120 are aligned with each other in the left-right direction, forming a recess for insertion of the display member 97. Furthermore, as shown in FIG. 36, after fixing, the end of the support portion 113 of the first portion 110 and the end of the base portion 121 of the second portion 120 come into contact with each other, so that the insertion portion 112 is restricted from being inserted further than in the state shown in FIG. 31.

Figure 37:
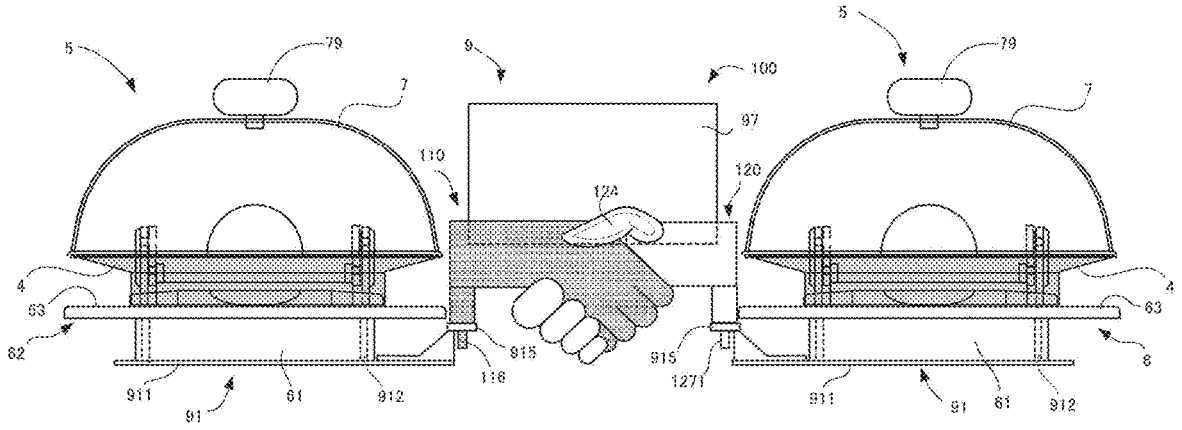
FIG. 37 is a front view of a pair of containers connected by the connector having the connecting portion of FIG. 31.

When the first portion 110 and the second portion 120 are fixed as described above, each of the protrusions 116, 1271 is fixed to the fixing portion 915 of the attachment portion 91. In this way, a structure in which two containers 5 are connected by the connector 9 is provided, as shown in FIG. 37.

<5. Features>

According to the connecting portion 100 as described above, the following advantageous effects can be obtained.

(1) Since the first portion 110 and the second portion 120 are colored in different colors, it is possible to emphasize that the two portions are connected to each other. In addition, since the connecting portion 100 itself is separated into two pieces, even after the connector 9 has been attached to the two containers 5, the connector 9 can be separated into two pieces, allowing each of the two containers 5 to be treated and stored separately.

(2) Since each of the first portion 110 and the second portion 120 has a shape of a hand, the two portions 110, 120 have a shape of handshake when the two portions are connected to each other, which can further emphasize the connection between the two portions.

(3) Since the connecting portion 100 is colored in a color different from that of the container 5, the presence of the connecting portion 100 can be emphasized.

(4) Since the insertion portion 112 of the first portion 110 is inserted obliquely downward into the second portion 120 to be fixed to the second portion 120, the first portion 110 and the second portion 120 are fixed in a direction intersecting the conveying direction of the conveying path. Therefore, the first portion 110 and the second portion 120 can be prevented from being separated from each other during conveyance. Furthermore, when the first portion 110 and the second portion 120 are fixed together, the engagement portion 1281 fits into the recess 118, thereby enabling the two portions 110, 120 to be firmly fixed to each other.

6. Modifications

The modified examples described below can be combined with the above-described embodiments, or aspects described in the modified examples can be combined with each other as appropriate. In this embodiment, as one aspect, each of the first portion 110 and the second portion 120 has a shape of a hand, and when the two portions are connected to each other, the two portions form a shape of a handshake. However, the present disclosure is not necessarily limited to this handshake shape. That is, shapes of the portions 110, 120 can be modified in various ways, as long as the separate portions can be connected to each other. For example, various shapes, such as a company logo, which can be separated into two halves may be used as long as such two separated portions can be connected to each other.

The first portion 110 and the second portion 120 do not necessarily have to be colored different colors, and may have the same color.

The connecting structure between the first portion 110 and the second portion 120 is not particularly limited. In this embodiment, as described above, the insertion portion 112 of the first portion 110 is inserted into the receiving portion 122 of the second portion 120 and is fixed thereto, but other methods are also used. For example, the two portions can be connected using various other members, for example, fastening members such as screws.

In this embodiment, the display member 97 is attached to the connector 9 so that information on the display member 97 can be presented to customers. However, even if the display member 97 is not used, it is possible for the connector to present certain messages to customers. That is, in this embodiment, the connecting portion 100 has a shape of a "handshake." In general, a handshake expresses affection and joy, and therefore customers can receive such messages from the shape of the handshake of the connecting portion 100. Furthermore, since the connector 9 connects the two containers 5 together, the shape of a handshake can indicate an intimate relationship between the two connected objects. Thus, for example, dishes from different countries can be placed in the containers 5 to show the friendly relationship between the two countries.

Figure 38:
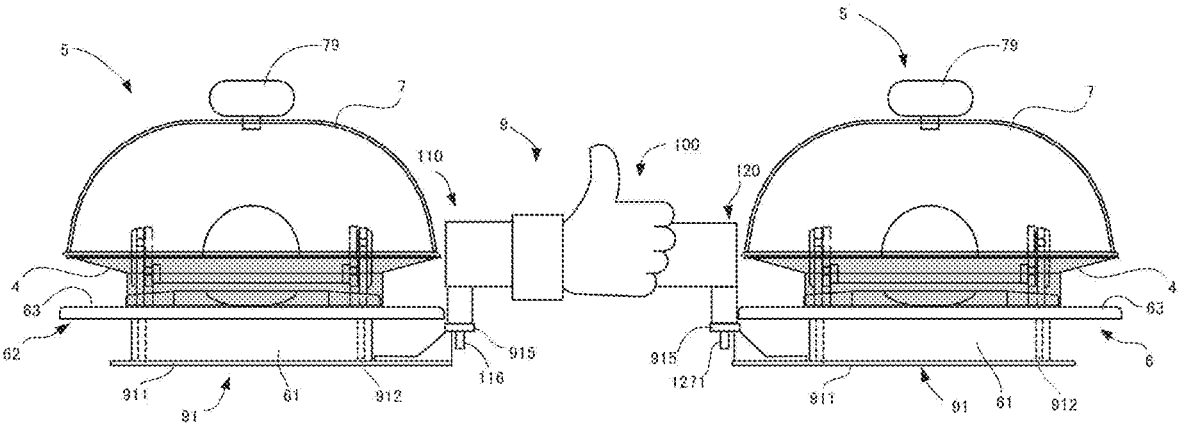
FIG. 38 is a front view of a pair of containers connected by a connector having another example of a connecting portion.

The shape of the connecting portion 100 is not necessarily limited to the handshake shape as described above, and may be of various other shapes. For example, as shown in FIG. 38, by making the connecting portion 100 into a shape of a hand with a thumbs up, it is possible to express a so-called "Like," thereby indicating that, for example, the food or drink being offered is good. The connecting portion 100 may be formed as one piece, or as described above, may be formed to be separable into two pieces. Moreover, the connecting portion 100 can be also designed with a character. Therefore, in the present disclosure, a "notification" in the phrase of "the connecting portion provides a notification that is visible to a customer" means that forming the connector to have a meaningful shape or a character design. In other words, providing a "notification" means presenting or displaying of some expressions, messages, or signs according to the design of the connector to customers. In addition to providing a "notification" by the shape of the connecting portion, such a "notification" can also be made by attaching letters, symbols, logos, signs, diagrams, messages, or any other types of information to the connecting portion.

D. Modifications

Although the embodiment of the present invention has been described above, the present invention is not necessarily limited to this, and various modifications are possible without departing from the spirit of the present invention. The following modifications can be combined as appropriate.

(1) The configuration of the container 5 shown in the above embodiments is merely an example, and the structure is not particularly limited as long as the container is capable of housing a plate 4 on which a food or drink is placed. For example, in the above embodiment, the base 61 is formed in a cylindrical shape, but the outer shape may be formed in a polygonal prism shape.

Figure 39:
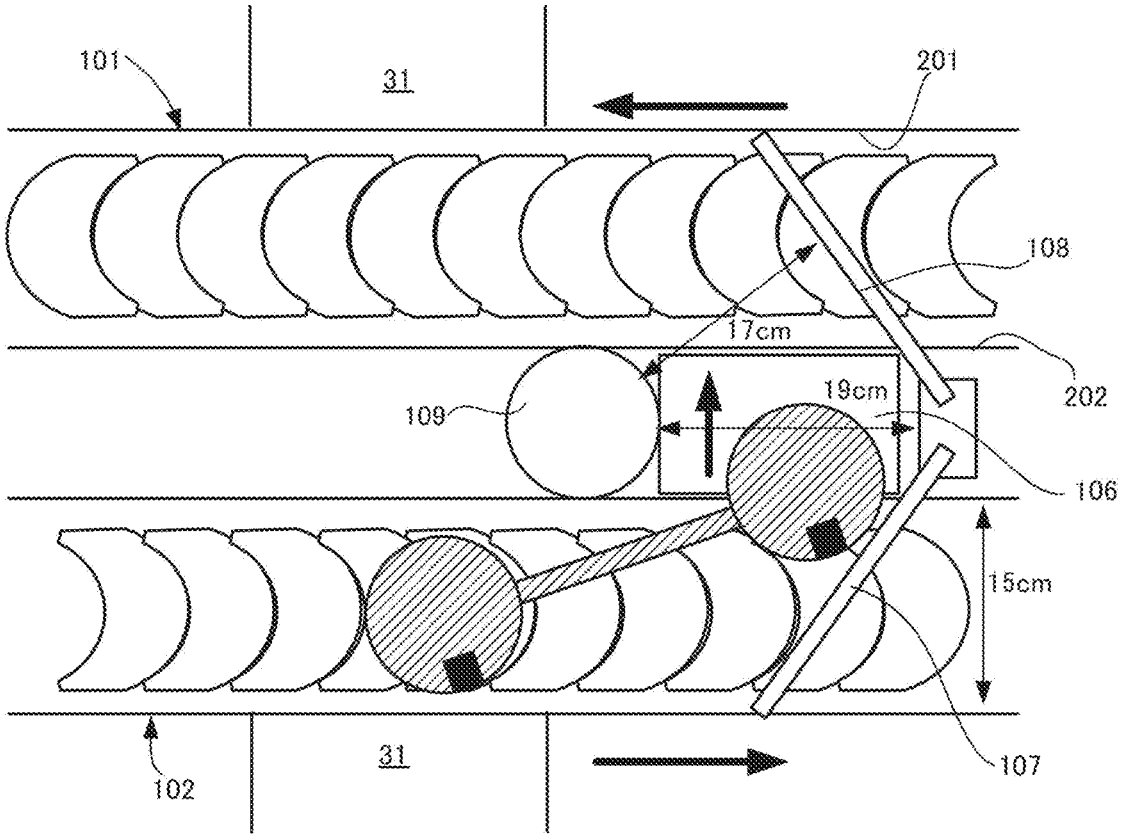
FIG. 39 is a plan view showing an overview of a quick turn mechanism.

(2) The conveying path 1 is just one example, and the length of the connector 9 can be determined appropriately based on the outer diameter of the container 5, the radius of curvature of the curved path 103 of the conveying path 1, and the width of the conveying path 1, as described above. For example, the above-mentioned quick turn mechanism may be formed as shown in FIG. 39. As shown in FIG. 39, the quick turn mechanism is used, for example, to form a bypass path for conveying the container 5 from a middle position of the second straight path 102 to a middle position of the first straight path 101. More specifically, the quick turn mechanism includes a conveyor 106 that is disposed between the second straight path 102 and the first straight path 101 and conveys the container 5 from the second straight path 102 to the first straight path 101, a first guide 107 for guiding the container 5 from the second straight path 102 to the conveyor 106, a second guide 108 for guiding the container 5 from the conveyor 106 to the first straight path 101, and a cylindrical inner edge member 109 that defines an inner edge of the bypass path. The first and second guides 107, 108 are disposed to intersect obliquely the second straight path 102 and the first straight path 101, respectively.

The dimensions of the bypass path using this quick turn mechanism are as shown in FIG. 31. The speed of the conveyor is 180-220 mm/sec. Even in such a bypass route, it is possible to pass through smoothly by adjusting the dimensions of the connector 9 and the container 5 in view of the bypass route as described above.

(3) The configuration of the connector 9 is not particularly limited, as long as the connector can be connected to the containers so that the angle of the connector with respect to each container 5 does not change and the distance between the two containers 5 does not change. In the above embodiment, the protrusions 93 are provided and inserted into the through holes 69 of the containers 5 to prevent the connector 9 from rotating relative to the containers 5, but other configurations may be used.

Furthermore, the configuration of the attachment portion 91 is not particularly limited, and the portion 91 may be configured to be mounted at a position other than the base 61 of the container 5. Also, attachment may be achieved by a method other than using a rubber material. Therefore, the location and method of attaching the attachment portion 91 to the container 5 are not particularly limited.

The configuration of the connecting portion 92 is not particularly limited as long as the connecting portion 92 is configured so that the display member 97 can be attached. In this case, the slit 924 is used as the display member attachment portion, but this is not necessarily limited thereto, and screws, hook-and-loop fasteners, etc. may also be used. In this case, the connecting portion 92 is not necessarily to have a display attachment portion formed thereon, and the display member 97 may be attached to the connecting portion 92 using adhesive, clips, or the like.

Furthermore, in the above embodiment, the connecting portion 92 and the attachment portions 91 are integrally formed, but as in the second embodiment, the connecting portion 92 may be detachably fixed to the attachment portions 91. In this case, the connecting structure between the attachment portions 91 and the connecting portion 92 is not particularly limited, and may be a method other than that of the second embodiment. Furthermore, the connecting portion 92 itself may be configured to be formed of multiple members that are connectable to one another.

In the above embodiment, the display member 97 is attached to the connecting portion 92, but the present disclosure is not necessarily limited to this example, and a configuration in which the display member 97 is not attached may be used. In this case, the connecting portion is formed to have a length sufficient to maintain a constant distance between multiple containers, and can also be used as a connector for connecting a pair of containers conveyed along a conveying path.

The invention claimed is:

1. A connector that connects two containers to each other, each of the two containers being configured to house a plate on which a food or a drink is placed and being conveyed on a conveying path of a conveying device that circulates in a restaurant, the connector comprising:

a pair of attachment portions each of which is attached to a respective one of the two containers, the pair of attachment portions being conveyed by the conveying device together with the two containers;

a connecting portion that is configured to connect the attachment portions to each other; and a display member integrally formed with the connecting portion and configured to present a notification visible to a customer, wherein the connecting portion has a length between the two containers for the display member that presents the notification.

2. The connector according to claim 1, wherein the display member has a lower end linearly extending, and the connecting portion has the length so that the lower end of the display member is placed on the connecting portion.

3. The connector according to claim 1, wherein the connecting portion has a rigidity to keep a constant distance between the two containers.

4. The connector according to claim 1, wherein each of the two containers has a base that is placed on the conveying path, and each of the attachment portions includes a support portion that is configured to support the base.

5. The connector according to claim 4, wherein the support portion includes an anti-rotation portion that is configured to restrict the support portion from rotating relative to the base.

6. The connector according to claim 1, wherein each of the two containers has a cylindrical base that is placed on the conveying path, and each of the attachment portions is formed in an annular shape to be attached to an outer circumferential surface of the cylindrical base.

7. The connector according to claim 1, wherein the connecting portion is fixed to the two containers at a constant angle relative to each of the two containers.

8. The connector according to claim 1, wherein the connecting portion includes a display member attachment portion to which the display member is attached.

9. A system comprising:

the conveying device in the restaurant; and the two containers connected by the connector of claim 1.

10. A connector that connects two containers to each other, each of the two containers being configured to house a plate on which a food or a drink is placed and being conveyed on a conveying path, the connector comprising:

a pair of attachment portions each of which is attached to a respective one of the two containers; and a connecting portion that is configured to connect the attachment portions to each other, wherein the connecting portion has a length so that a display member that presents a notification visible to a customer is attached to the connecting portion, each of the two containers has a base that is placed on the conveying path, each of the attachment portions includes a support portion that is configured to support the base, and the support portion includes an anti-rotation portion that is configured to restrict the support portion from rotating relative to the base.

11. A system comprising:

a conveying device in a restaurant; and the two containers connected by the connector of claim 10 conveyed by the conveying device in the restaurant.

12. A connector that connects two containers to each other, each of the two containers being configured to house a plate on which a food or a drink is placed and being conveyed on a conveying path of a conveying device that circulates in a restaurant, the connector comprising:

a pair of attachment portions each of which is attached to a respective one of the two containers, the pair of attachment portions being conveyed by the conveying device together with the two containers;

a connecting portion that is configured to connect the attachment portions to each other; and a display member having a meaningful shape or a character design and configured to present a notification visible to a customer, wherein the connecting portion has a length between the two containers for the display member that presents the notification.

13. A system comprising:

the conveying device in the restaurant; and the two containers connected by the connector of claim 12.

* * * * *